US006362136B1

(12) United States Patent
Richardson et al.

(10) Patent No.: US 6,362,136 B1
(45) Date of Patent: Mar. 26, 2002

(54) COMPOSITIONS FOR EXTENDING SEAL LIFE, AND LUBRICANTS AND FUNCTIONAL FLUIDS CONTAINING THE SAME

(75) Inventors: Robert C. Richardson, Mentor; Donald J. Marn, Wickliffe, both of OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 08/622,620

(22) Filed: Mar. 26, 1996

Related U.S. Application Data

(63) Continuation of application No. 08/248,277, filed on May 23, 1994, now abandoned.

(51) Int. Cl.[7] ..... C10M 141/08

(52) U.S. Cl. ..... 508/186; 508/221; 508/322; 508/421; 508/442; 508/378; 508/558; 508/567; 508/569

(58) Field of Search ..... 508/567, 186, 508/378, 221, 322, 442, 421, 558, 569

(56) References Cited

U.S. PATENT DOCUMENTS

| | | | | | |
|---|---|---|---|---|---|
| 1,966,050 | A | * | 7/1934 | Sloane | 252/45 |
| 2,257,890 | A | * | 10/1941 | Sloane | 252/45 |
| 2,298,639 | A | | 10/1942 | Prutton | 252/45 |
| 2,298,640 | A | | 10/1942 | Prutton | 252/50 |
| 2,382,700 | A | * | 8/1945 | Eby | 252/45 |
| 2,738,330 | A | * | 3/1956 | Hill | 252/45 |
| 2,882,229 | A | | 4/1959 | Richardson | 252/32.7 |
| 2,941,945 | A | * | 6/1960 | Farnman et al. | 252/45 |
| 3,087,936 | A | | 4/1963 | Le Suer | 260/326.3 |
| 3,197,405 | A | | 7/1965 | Le Suer | 252/32.7 |
| 3,213,020 | A | | 10/1965 | Hopkins | 252/32.7 |
| 3,213,021 | A | | 10/1965 | Hopkins | 252/32.7 |
| 3,213,022 | A | | 10/1965 | Hopkins | 252/32.7 |
| 3,219,666 | A | | 11/1965 | Norman | 260/268 |
| 3,254,025 | A | | 5/1966 | Le Suer | 252/32.7 |
| 3,282,955 | A | | 11/1966 | Le Suer | 260/326.3 |
| 3,313,727 | A | | 4/1967 | Peeler | 252/18 |
| 3,471,404 | A | | 10/1969 | Myers | 252/45 |
| 3,533,945 | A | | 10/1970 | Vogel | 252/49.6 |
| 3,544,465 | A | | 12/1970 | Braid | 252/46.6 |
| RE27,331 | E | | 4/1972 | Coleman | 252/47.5 |
| 3,666,662 | A | | 5/1972 | Lowe | 252/33.6 |
| 3,997,454 | A | | 12/1976 | Adams | 252/18 |
| 4,029,587 | A | | 6/1977 | Koch | 252/48.2 |
| 4,089,790 | A | | 5/1978 | Adams | 252/18 |
| 4,119,549 | A | | 10/1978 | Davis | 252/45 |
| 4,119,550 | A | | 10/1978 | Davis et al. | 252/45 |
| 4,191,659 | A | | 3/1980 | Davis | 252/45 |
| 4,234,435 | A | | 11/1980 | Meinhardt et al. | 252/51.5 |
| 4,260,503 | A | | 4/1981 | Michaelis | 252/48.6 |
| 4,308,154 | A | | 12/1981 | Clason et al. | 252/32.7 |
| 4,344,854 | A | | 8/1982 | Davis | 252/45 |
| 4,417,990 | A | | 11/1983 | Clason et al. | 252/32.7 |
| 4,510,062 | A | | 4/1985 | Nakanishi | 252/45 |
| 4,582,618 | A | | 4/1986 | Davis | 252/32.7 |
| 4,584,115 | A | | 4/1986 | Davis | 252/49.6 |
| 4,670,169 | A | | 6/1987 | Adams et al. | 252/46.7 |
| 4,744,920 | A | | 5/1988 | Fischer et al. | 252/33.4 |
| 4,755,311 | A | | 7/1988 | Burjes et al. | 252/49.9 |
| 4,792,410 | A | | 12/1988 | Schwind et al. | 252/38 |
| 4,876,374 | A | | 10/1989 | Adams et al. | 558/109 |
| 4,925,983 | A | | 5/1990 | Steckel | 564/8 |
| 5,230,714 | A | | 7/1993 | Steckel | 44/432 |

FOREIGN PATENT DOCUMENTS

| | | |
|---|---|---|
| EP | 450208 | 4/1990 |
| GB | 601479 | 9/1945 |
| WO | 8805810 | 8/1988 |

OTHER PUBLICATIONS

EP 95 10 7492; European Search Report mailed Feb. 19, 1996.

* cited by examiner

*Primary Examiner*—Jacqueline V. Howard
(74) *Attorney, Agent, or Firm*—Michael F. Esposito

(57) ABSTRACT

This invention relates to compositions containing a sulfur containing antiwear/extreme pressure agent, basic nitrogen compound or a mixture thereof together with a hydrocarbyl mercaptan. The composition may additionally contain a phosphorus or boron antiwear or extreme pressure agent, a dispersant or an overbased metal salt. The invention also relates to lubricants, functional fluids, and concentrates containing the same. Seals, e.g. nitrile, polyacrylate, and fluoroelastomer, in contact with these composition have reduced deterioration. With the use of these compositions, lubricants, and functional fluids, the seals' useful life is extended.

44 Claims, No Drawings

COMPOSITIONS FOR EXTENDING SEAL LIFE, AND LUBRICANTS AND FUNCTIONAL FLUIDS CONTAINING THE SAME

This is a continuation of application Ser. No. 08/248,277 filed on May 23, 1994, now abandoned.

TECHNICAL FIELD OF THE INVENTION

This invention relates to compositions for extending seal life. These compositions contain a hydrocarbyl mercaptan and a sulfur containing antiwear or extreme pressure agent, a basic nitrogen compound, or mixture thereof. The invention also relates to lubricants, greases and functional fluids containing the same.

BACKGROUND OF THE INVENTION

Seals are used in design and manufacture of engines, gear assemblies and transmissions to maintain the fluid or lubricant within the apparatus. The seals come in contact with the lubricant and may, under operating conditions, lose their elasticity and become brittle. Often the deterioration of seals is affected by the additives present in the lubricant. To solve problems associated with seal deterioration, formulators of lubricants have used additives to protect seal or cause swelling of the seals. Sulfolenes are an example of such seal swell agents.

Seals are typically made of nitrile rubber, fluoroelastomers and polyacrylates. It is desirable to use low cost seals in designing equipment. Accordingly, a need exists for improving the operating life of seals, especially nitrile and polyacrylate seals.

SUMMARY OF THE INVENTION

This invention relates to compositions containing a sulfur containing antiwear/extreme pressure agent, basic nitrogen compound or a mixture thereof together with a hydrocarbyl mercaptan. The compositions may additionally contain a phosphorus or boron antiwear or extreme pressure agent, a dispersant or an overbased metal salt. The invention also relates to lubricants, functional fluids, and concentrates containing the same. Seals, e.g. nitrile, polyacrylate, and fluoroelastomer, in contact with these composition have reduced deterioration. With the use of these compositions, lubricants, and functional fluids, the useful life of seals is extended.

DESCRIPTION OF THE PREFERRED EMBODIMENTS

The term "hydrocarbyl" includes hydrocarbon as well as substantially hydrocarbon groups. Substantially hydrocarbon describes groups which contain heteroatom substituents that do not alter the predominantly hydrocarbon nature of the substituent. Examples of hydrocarbyl groups include the following:

(1) hydrocarbon substituents, i.e., aliphatic (e.g., alkyl or alkenyl) and alicyclic (e.g., cycloalkyl, cycloakenyl) substituents, aromatic-, aliphatic- and alicyclic-substituted aromatic substituents and the like as well as cyclic substituents wherein the ring is completed through another portion of the molecule (that is, for example, any two indicated substituents may together form an alicyclic radical);

(2) substituted hydrocarbon substituents, i.e., those substituents containing non-hydrocarbon groups which, in the context of this invention, do not alter the predominantly hydrocarbon nature of the substituent; those skilled in the art will be aware of such groups (e.g., halo (especially chloro and fluoro), hydroxy, mercapto, nitro, nitroso, sulfoxy, etc.);

(3) heteroatom substituents, i.e., substituents which will, while having a predominantly hydrocarbon character within the context of this invention, contain an atom other than carbon present in a ring or chain otherwise composed of carbon atoms (e.g., alkoxy or alkylthio). Suitable heteroatoms will be apparent to those of ordinary skill in the art and include, for example, sulfur, oxygen, nitrogen and such substituents as, e.g. pyridyl, furyl, thienyl, imidazolyl, etc.

In general, no more than about 2, preferably no more than one heteroatom substituent will be present for every ten carbon atoms in the hydrocarbyl group. Typically, there will be no such heteroatom substituents in the hydrocarbyl group. Therefore, the hydrocarbyl group is purely hydrocarbon.

As described above, the lubricants and functional fluids contain (A) a sulfur containing antiwear or extreme pressure agent and/or a basic nitrogen compound in combination with (B) a hydrocarbyl mercaptan. In one embodiment, (A) is present at concentrations in the range of about 0.05% to about 10% by weight, or preferably, from about 0.1% up to about 8%, or more preferably from about 0.3% up to about 7%, more preferably from about 0.5% to about 5% by weight. Here, as well as elsewhere in the specification and claims, the range and ratio limits may be combined. In one embodiment, (A) is used in crankcase lubricants in an amount from about 0.01% up to about 6%, or preferably from about 0.05% up to about 5%, or more preferably from about 0.1% up to about 3% by weight. In another embodiment, (A) is used in a driveline or transmission fluid, in an amount from about 0.5% up to about 10%, preferably from about 1% up to about 7%, or from about 2% up to about 6% by weight. When a mixture of sulfur containing compounds and basic nitrogen compounds is used, then each component may be independently present in the amounts given above.

Sulfur Containing Antiwear/Extreme Pressure Agent

The sulfur containing antiwear and/or extreme pressure agent (A) includes sulfur compounds, such as sulfurized olefins, metal thiophosphates, organic ammonium thiosulfates, or mixtures thereof. The sulfur compounds include mono- or polysulfide compositions, or mixtures thereof. The sulfur compounds are generally characterized as having sulfide linkages containing an average from 1 up to about 10, or from about 2 up to about 8, or from about 3 up to about 4 sulfur atoms. In one embodiment, the organic polysulfides may be a mixture of di-, tri- or tetrasulfide materials, preferably having a majority of trisulfide. Materials having at least 70% trisulfide are preferred, with materials containing greater than 80% trisulfide more preferred.

In one embodiment, the sulfur containing antiwear or extreme pressure agent is a sulfurized compound. Materials which may be sulfurized include oils, unsaturated fatty acids, unsaturated fatty esters, olefins, terpenes, or Diels-Alder adducts. Oils which may be sulfurized are natural or synthetic oils, including mineral oils, lard oil, carboxylic acid esters derived from aliphatic alcohols and fatty acids or aliphatic carboxylic acids (e.g., myristyl oleate and oleyl oleate), and synthetic sperm whale oil substitutes and synthetic unsaturated esters or glycerides.

The unsaturated fatty acids generally contain from about 8 to about 30, or from about 12 to about 24 carbon atoms.

Examples of unsaturated fatty acids include palmitoleic acid, oleic, linoleic, linolenic, erucic acid, lard oil acid, soybean oil acid, tall oil and rosin acid.

The unsaturated fatty esters include fatty oils, that is, naturally occurring or synthetic esters of glycerol and one or more of the above fatty acids. Examples of fatty esters include animal fats, such as Neat's-foot oil, lard oil, depot fat, beef tallow, vegetable oils including cottonseed oil, corn oil, safflower oil, sesame oil, soybean oil, and sunflower seed oil. The unsaturated fatty esters also may be prepared by esterifying alcohols and polyols with a fatty acid. The alcohols include the above described mono- and polyhydric alcohols, such as methanol, ethanol, propanol, butanol, ethylene glycol, neopentyl glycol, and glycerol.

The olefins, which may be sulfurized, contain at least one olefinic double bond, which is defined as a non-aromatic double bond. The olefins include the dienes described below. In its broadest sense, the olefin may be defined by the formula $R^{*1}R^{*2}C{=}CR^{*3}R^{*4}$, wherein each of $R^{*1}$, $R^{*2}$, $R^{*3}$, and $R^{*4}$ is hydrogen, or an organic group. In general, the R* groups in the above formula which are not hydrogen may be represented by $—(CH_2)_n—A$, wherein n is a number from 0 to about 10 and A is represented by $—C(R^{*5})_3$, $—COOR^{*5}$, $—CON(R^{*5})_2$, $—COON(R^{*5})_4$, —COOM, —CN, —X, $—YR^{*5}$ or —Ar, wherein: each $R^{*5}$ is independently hydrogen, or a hydrocarbyl group, with the proviso that any two $R^{*5}$ groups may be connected to form a ring of up to about 12 carbon atoms; M is one equivalent of a metal cation (preferably Group I or II, e.g., sodium, potassium, barium, or calcium); X is halogen (e.g., chloro, bromo, or iodo); Y is oxygen or divalent sulfur: Ar is an aromatic group of up to about 12 carbon atoms.

The olefinic compound is usually one in which each R group which is not hydrogen is independently alkyl, alkenyl or aryl group. In one embodiment, $R^{*3}$ and $R^{*4}$ are hydrogen and $R^{*1}$ and $R^{*2}$ are alkyl or aryl, especially alkyl having from 1 up to about 30, or up to about 16, or up to about 8, or even up to about 4 carbon atoms. Olefins having from 2 up to about 30, or from about 3 up to about 16 (most often less than about 9) carbon atoms are particularly useful. Olefins having from 2 up to about 5, or from 2 up to about 4 carbon atoms are particularly useful. Isobutene, propylene and their dimers, trimers and tetramers, and mixtures thereof are especially preferred olefins. Of these compounds, isobutylene and diisobutylene are particularly desirable. In one embodiment, the organic polysulfides may be a mixture of di-, tri- or tetrasulfide materials, preferably having a majority of trisulfide. Materials having at least 70% trisulfide are preferred, with materials containing greater than 80% trisulfide more preferred.

In another embodiment, the organic polysulfide comprise sulfurized olefins prepared by the sulfochlorination of olefins containing four or more carbon atoms and further treatment with inorganic higher polysulfides according to U.S. Pat. No. 2,708,199.

In one embodiment, the sulfurized olefins may be produced by (1) reacting sulfur monochloride with a stoichiometric excess of a lower olefin, e.g. containing two to about seven carbon atoms, (2) treating the resulting product with an alkali metal sulfide in the presence of free sulfur in a mole ratio of no less than 2:1 in an alcohol-water solvent, and (3) reacting that product with an inorganic base. This procedure is described in U.S. Pat. No. 3,471,404, and the disclosure of U.S. Pat. No. 3,471,404 is hereby incorporated by reference for its discussion of this procedure for preparing sulfurized olefins and the sulfurized olefins thus produced. Generally, the olefin reactant contains from about 2 to about 5 carbon atoms and examples include ethylene, propylene, butylene, isobutylene, amylene, etc.

The sulfurized olefin may also be prepared by reacting, under superatmospheric pressure, the olefin with a mixture of sulfur and hydrogen sulfide in the presence, or absence, of a catalyst, followed by removal of low boiling materials. The olefins which may be sulfurized, the sulfurized olefin, and methods of preparing the same are described in U.S. Pat. Nos. 4,119,549, 4,199,550, 4,191,659, and 4,344,854. The disclosure of these patents is hereby incorporated by reference for its description of the sulfurized olefins and preparation of the same.

The following examples relate to sulfurized olefins. Unless the context clearly indicates otherwise, here, as well as throughout the specification and claims, the amounts are by weight, the temperature is in degrees Celsius and the pressure is atmospheric.

EXAMPLE S-1

Sulfur (526 parts, 16.4 moles) is charged to a jacketed, high-pressure reactor which is fitted with an agitator and internal cooling coils. Refrigerated brine is circulated through the coils to cool the reactor prior to the introduction of the gaseous reactants. After sealing the reactor, evacuating to about 2 torr and cooling, 920 parts (16.4 moles) of isobutene and 279 parts (8.2 moles) of hydrogen sulfide are charged to the reactor. The reactor is heated using steam in the external jacket, to a temperature of about 182° C. over about 1.5 hours. A maximum pressure of 1350 psig is reached at about 168° C. during this heat-up. Prior to reaching the peak reaction temperature, the pressure starts to decrease and continues to decrease steadily as the gaseous reactants are consumed. After about 10 hours at a reaction temperature of about 182° C., the pressure is 310–340 psig and the rate of pressure change is about 5–10 psig per hour. The unreacted hydrogen sulfide and isobutene are vented to a recovery system. After the pressure in the reactor has decreased to atmospheric, the sulfurized mixture is recovered as a liquid. The mixture is blown with nitrogen at about 100° C. to remove low boiling materials including unreacted isobutene, mercaptans and monosulfides. The residue after nitrogen blowing is agitated with 5% Super Filtrol and filtered, using a diatomaceous earth filter aid. The filtrate is the desired sulfurized composition which contains 42.5% sulfur.

EXAMPLE S-2

Sulfur monochloride (2025 grams, 15.0 moles) is heated to 45° C. Through a sub-surface gas sparge, 1468 grams (26.2 moles) of isobutylene gas are fed into the reactor over a 5-hour period. The temperature is maintained between 45–50° C. At the end of the sparging, the reaction mixture increases in weight of 1352 grams. In a separate reaction vessel are added 2150 grams (16.5 moles) of 60% flake sodium sulfide, 240 grams (7.5 moles) sulfur, and a solution of 420 ml. of isopropanol in 4000 ml. of water. The contents are heated to 40° C. The adduct of the sulfur monochloride and isobutylene previously prepared is added over a three-quarter hour period while permitting the temperature to rise to 75° C. The reaction mixture is heated to reflux for 6 hours, and afterward the mixture is permitted to form into separate layers. The lower aqueous layer is discarded. The upper organic layer is mixed with two liters of 10% aqueous sodium hydroxide, and the mixture is heated to reflux for 6 hours. The organic layer is again removed and washed with one liter of water. The washed product is dried by heating at 90° C. and 30 mm. Hg. pressure for 30 minutes. The residue is filtered through diatomaceous earth filter aid to give 2070 grams of a clear yellow-orange liquid.

In another embodiment, sulfur compound is a sulfurized terpene compound. The term "terpene compound" as used in the specification and claims is intended to include the various isomeric terpene hydrocarbons having the empirical formula $C_{10}H_{16}$, such as contained in turpentine, pine oil and dipentenes, and the various synthetic and naturally occurring oxygen-containing derivatives. Pine-oil derivatives, which are commercially available from Hercules Incorporated, include alpha-terpineol (a high purity tertiary terpene alcohol); and Terpineol 318 Prime (a mixture containing about 60–65% weight alpha-terpineol and 15–20% weight beta-terpineol); Yarmor 302; Herco pine oil; Yarmor 302W; Yarmor F; and Yarmor 60.

In another embodiment, sulfur compound is a sulfurized Diels-Alder adduct. The sulfurized Diels-Alder adduct is prepared by reacting a sulfur source, such as elemental sulfur, sulfur halides and organic polysulfides, including dialkyl polysulfides. A Diels-Alder reaction involves the reaction of at least one conjugated diene with at least one ethylenically or acetylenically unsaturated compound, these latter compounds being known as dienophiles. Piperylene, isoprene, methylisoprene, chloroprene, and 1,3-butadiene are among the preferred dienes for use in preparing the Diels-Alder adducts. Other dienes include linear 1,3-conjugated dienes, cyclic dienes, such as cyclopentadienes, fulvenes, 1,3-cyclohexadienes, 1,3,5-cycloheptatrienes, cyclooctatetraene, etc.

Dienophiles, used in preparing the Diels-Alder adducts, include nitroalkenes; alpha, beta-ethylenically unsaturated carboxylic esters, acids or amides; ethylenically unsaturated aldehydes and vinyl ketones. The unsaturated carboxylic esters, acids and amides are described below. Specific examples of dienophiles include 1-nitrobutene-1-alkylacrylates, acrylamide, N,N'-dibutylacrylamide, methacrylamide, crotonaldehyde; crotonic acid, dimethyldivinyl ketone, methylvinyl ketone, propiolaldehyde, methylethynyl ketone, propiolic acid, propargylaldehyde, cyclopentenedione, 3-cyano-coumaran, etc. The sulfurized Diels-Alder adducts are readily prepared by heating a mixture of a sulfur source, preferably elemental sulfur and at least one of the Diels-Alder adducts of the types discussed hereinabove at a temperature within the range of from about 110° C. to just below the decomposition temperature of the Diels-Alder adducts. Temperatures within the range of about 110° to about 200° C. will normally be used. Generally, the molar ratio of sulfur source to Diels-Alder adduct is in a range of from about 0.75 up to about 4, or from about 1 up to about 3, or up to about 2.5. The Diels-Alder adducts are a well-known, art-recognized class of compounds prepared from dienes by a Diels-Alder reaction. An example of a useful sulfurized Diels-Alder adduct is a sulfurized Diels-Alder adduct of butadiene and butyl-acrylate. Sulfurized Diels-Alder adducts are described in U.S. Pat. Nos. 3,498,915, 4,582,618, and Re 27,331. These patents are hereby incorporated by reference for their disclosures of sulfurized Diels-Alder adducts and methods of making the same.

In another embodiment, the sulfur containing antiwear or extreme pressure agent is a metal thiophosphate, such as metal dithiophosphates. The metal thiophosphate are prepared by reacting a metal base with one or more thiophosphorus acids. The thiophosphorus acid may be prepared by reacting one or more phosphorus sulfides, which include phosphorus pentasulfide, phosphorus sesquisulfide, phosphorus heptasulfide and the like, with one or more alcohols. The thiophosphorus acid may be mono- or dithiophosphorus acids. The alcohols generally contain from one to about 30, or from two to about 24, or from about 3 to about 12, or up to about 8 carbon atoms. Alcohols used to prepare the thiophosphoric acids include butyl, amyl, 2-ethylhexyl, hexyl, octyl, oleyl, and cresol alcohols. Examples of commercially available alcohols include Alfol 810 (a mixture of primarily straight chain, primary alcohols having from 8 to 10 carbon atoms); Alfol 1218 (a mixture of synthetic, primary, straight-chain alcohols containing 12 to 18 carbon atoms); Alfol 20+ alcohols (mixtures of $C_{18}$–$C_{28}$ primary alcohols having mostly $C_{20}$ alcohols as determined by GLC (gas-liquid-chromatography); and Alfol 22+ alcohols ($C_{18}$–$C_{28}$ primary alcohols containing primarily $C_{22}$ alcohols). Alfol alcohols are available from Continental Oil Company. Another example of a commercially available alcohol mixtures are Adol 60 (about 75% by weight of a straight chain $C_{22}$ primary alcohol, about 15% of a $C_{20}$ primary alcohol and about 8% of $C_{18}$ and $C_{24}$ alcohols) and Adol 320 (oleyl alcohol). The Adol alcohols are marketed by Ashland Chemical.

A variety of mixtures of monohydric fatty alcohols derived from naturally occurring triglycerides and ranging in chain length of from $C_8$ to $C_{18}$ are available from Procter & Gamble Company. These mixtures contain various amounts of fatty alcohols containing mainly 12, 14, 16, or 18 carbon atoms. For example, CO-1214 is a fatty alcohol mixture containing 0.5% of $C_{10}$ alcohol, 66.0% of $C_{12}$ alcohol, 26.0% of $C_{14}$ alcohol and 6.5% of $C_{16}$ alcohol.

Another group of commercially available mixtures include the "Neodol" products available from Shell Chemical Co. For example, Neodol 23 in a mixture of $C_{12}$ and $C_{13}$ alcohols; Neodol 25 is a mixture of $C_{12}$ and $C_{15}$ alcohols; and Neodol 45 is a mixture of $C_{14}$ to $C_{15}$ linear alcohols. Neodol 91 is a mixture of $C_9$, $C_{10}$ and $C_{11}$ alcohols.

Fatty vicinal diols also are useful and these include those available from Ashland Oil under the general trade designation Adol 114 and Adol 158. The former is derived from a straight chain alpha-olefin fraction of $C_{11}$–$C_{14}$, and the latter is derived from a $C_{15}$–$C_{18}$ alpha-olefin fraction.

In one embodiment, the phosphorus acid is a monothiophosphoric acid. Monothiophosphoric acids may be prepared by the reaction of a sulfur source with a dihydrocarbyl phosphite. The sulfur source may for instance be elemental sulfur, or a sulfide, such as a sulfur coupled olefin or a sulfur coupled dithiophosphate. Elemental sulfur is a preferred sulfur source. The preparation of monothiophosphoric acids are disclosed in U.S. Pat. No. 4,755,311 and PCT Publication WO 87/07638, which are incorporated herein by reference for their disclosure of monothiophosphoric acids, sulfur sources, and the process for making monothiophosphoric acids. Monothiophosphoric acids may also be formed in the lubricant blend by adding a dihydrocarbyl phosphite to a lubricating composition containing a sulfur source, such as a sulfurized olefin. The phosphite may react with the sulfur source under blending conditions (i.e., temperatures from about 30° C. to about 100° C., or higher) to form the monothiophosphoric acid.

In another embodiment, the phosphorus acid is a dithiophosphoric acid or phosphorodithioic acid. The dithiophosphoric acid may be represented by the formula $(R_1O)_2PSSH$, wherein each $R_1$ is independently a hydrocarbyl group, containing from about 3 to about 30, or from about 3 up to about 18, or from about 4 up to about 12, or up to about 8 carbon atoms. Examples $R_1$ include isopropyl, isobutyl, n-butyl, sec-butyl, amyl, n-hexyl, methylisobutyl carbinyl, heptyl, 2-ethylhexyl, isooctyl, nonyl, behenyl, decyl, dodecyl, tridecyl, alkylphenyl groups, or mixtures thereof. Illustrative lower alkylphenyl $R_1$ groups include butylphenyl, amylphenyl, and heptylphenyl and mixtures thereof. Examples of mixtures of $R_1$ groups include: 1-butyl and 1-octyl; 1-pentyl and 2-ethyl-1-hexyl; isobutyl and n-hexyl; isobutyl and isoamyl; 2-propyl and 2-methyl-4-pentyl; isopropyl and sec-butyl; and isopropyl and isooctyl.

The metal thiophosphates are prepared by the reaction of a metal base with the thiophosphorus acid. The metal base may be any metal compound capable of forming a metal salt. Examples of metal bases include metal oxides, hydroxides, carbonates, sulfates, borates, or the like. The metals of the metal base include Group IA, IIA, IB through VIIB, and VIII metals (CAS version of the Periodic Table of the Elements). These metals include the alkali metals, alkaline earth metals and transition metals. In one embodiment, the metal is a Group IIA metal, such as calcium or magnesium, a Group IB metal, such as copper, a Group IIB metal, such as zinc, or a Group VIIB metal, such as manganese. Preferably the metal is magnesium, calcium, copper or zinc. Examples of metal compounds which may be reacted with the phosphorus acid include zinc hydroxide, zinc oxide, copper hydroxide, copper oxide, etc.

Examples of metal dithiophosphates include zinc isopropyl, methylamyl dithiophosphate, zinc isopropyl isooctyl dithiophosphate, barium di(nonyl) dithiophosphate, zinc di(cyclohexyl) dithiophosphate, copper di(isobutyl) dithiophosphate, calcium dichexyl) dithiophosphate, zinc isobutyl isoamyl dithiophosphate, and zinc isopropyl secondary-butyl dithiophosphate.

In one embodiment, the sulfur containing antiwear and/or extreme pressure agent is an organic ammonium thiosulfate. The organic ammonium thiosulfate is oil soluble or dispersible. The term organic refers to ammonium thiosulfates which contain carbon atoms. The organic ammonium thiosulfate may be prepared by any means known to those in the art. The organic ammonium thiosulfate is generally formed using an amine. The amine may be any of those described below, such as the fatty amines, tertiary aliphatic primary amines, primary ether amines, etc. In one embodiment, the amine is one or more of the acylated amines, hydrocarbyl substituted amines, Mannich reaction products, or post treated products thereof described below.

In one embodiment, the organic ammonium thiosulfate is prepared by reacting ammonium thiosulfate with an amine with the resultant release of ammonia. The reaction generally occurs at a temperature from about 70° C. up to about 150° C., or from about 90° C. up to about 130° C. Generally from about 0.5, or from about 1 up to about 2 moles of amine are reacted with one mole of ammonium thiosulfate. An excess of amine may be used.

In another embodiment, the organic ammonium thiosulfate is prepared by reacting a mixture of an amine with a sulfurous acid, anhydride, or ester to form an intermediate. The intermediate is then reacted with a sulfur source. The reaction to form the intermediate may occur in the presence of water. Examples of sulfurous acids, anhydrides, and esters include sulfurous acid, ethylsulfonic acid, sulfur dioxide, thiosulfuric acid, dithionous acid, etc. The intermediate-forming reaction of the amine and sulfurous acid, anhydride, or ester occurs at a temperature from about 25° C. up to about 100° C., or from about 50° C. up to about 80° C. Typically an excess of sulfurous acid, ester, or anhydride is blown into a mixture of water and an amine. Generally the amine and sulfurous acid, anhydride, or ester are reacted in equal molar amounts.

The intermediate, formed from the amine and the sulfurous acid, anhydride, or ester, is then further reacted with a sulfur source to form the organic ammonium thiosulfate. The temperature is generally from about room temperature up to the decomposition temperature of the individual reactants or the reaction mixture. Typically, the reaction temperature is from about 20° C. up to about 300° C., or from about 30° C. up to about 200° C., or up to about 150° C. Typically, from about 0.1 up to about 10, or from about 0.3 up to about 5, or from about 0.5 up to about 1.5 equivalents of sulfur is reacted with each equivalent of sulfur present from the sulfurous acid, ester, or anhydride. Typically, an equivalent of the sulfur source is reacted with an equivalent of the reaction product of the amine and sulfurous acid, ester, or anhydride. The equivalents of reaction product is determined on a sulfur basis.

The sulfur source may be any of a variety of materials which are capable of supplying sulfur to the reaction. Examples of useful sulfur sources include elemental sulfur, sulfur halides, combinations of sulfur or sulfur oxides with hydrogen sulfide, and various sulfur containing organic compounds, such as those described herein. U.S. Pat. No. 4,755,311 discloses various sulfur sources capable of supplying sulfur to reactions. This patent is incorporated by reference for its disclosure of sulfur sources.

The following examples relate to organic ammonium thiosulfate and methods of making the same.

EXAMPLE S-3

A reaction vessel is charged with 200 grams (1 equivalent) a tertiary aliphatic primary amine, having an average molecular weight of 191, in which the aliphatic radical is a mixture of tertiary alkyl radicals containing from 11 to 14 carbon atoms, 100 milliliters of toluene, and 100 grams of 100 neutral mineral oil. The mixture is heated to 50° C., where 74 grams (0.5 equivalent) of ammonium thiosulfate, dissolved in 100 grams of water, is added to the reaction vessel over 60 minutes. The mixture is heated to reflux and the temperature is maintained for one hour. Ammonia evolves from the reaction. The reaction is heated to 120° C., where 100 milliliters of aqueous distillate is recovered. The reaction mixture is cooled to room temperature where 100 grams of 100 neutral mineral oil is added to the vessel. The mixture is heated to 60° C. where 100 milliliters of water is added to the vessel. The mixture is heated to reflux (90° C.) and the temperature is maintained for 15 hours. The reaction vessel is heated to 110–120° C. and the temperature is maintained for 16 hours. The reaction mixture is cooled to room temperature and the upper liquid layer is decanted. The liquid layer is the desired product. The product contains 31% mineral oil and 31% toluene. The product contains 3.4% sulfur, 3.1% nitrogen, and has a 46.3 total acid number and a 54.4 total base number.

EXAMPLE S-4

A reaction vessel is charged with 500 grams (1 equivalent) of a 40% oil solution of a reaction product of a polybutenyl ($\overline{M}n$=950) substituted succinic anhydride reacted with a polyamine bottom generally having the structure of tetraethylenepentamine (wherein the reaction product has a total base number of 70 and 2.5% nitrogen). The reaction temperature is increased to 105° C., where 37 grams (0.5 equivalent) of ammonium thiosulfate, dissolved in 50 grams of water, is added dropwise under a 1.5 standard cubic foot per hour (SCFH) nitrogen flow. Reaction temperature is increased to 100–120° C., and is maintained for 8 hours while removing aqueous distillate. A total of 50 milliliters of aqueous distillate is removed. The reaction mixture is filtered through diatomaceous earth. The filtrate is the desired product. The product has 2.4% nitrogen, 2.2% sulfur, and has a 20.5 total acid number and a 20.7 total base number.

EXAMPLE S-5

A reaction vessel is charged with 95 grams (0.5 equivalent) of the tertiary aliphatic amine of example S-3, 144 grams (0.5 equivalent) of oleylamine, and 9 grams of water. The mixture is blown with sulfur dioxide at 0.5 standard cubic foot per hour (GCPR) for 1.5 hours. The temperature rises to 50° C. Toluene (100 milliliters) is added to the reaction vessel and the temperature is increased to 70° C. The mixture is then blown with $SO_2$ for 1 hour at 0.5 SCFH. The total moles of sulfur dioxide added to the vessel is 1.56 moles. The reaction temperature is increased to 100–120° C. where sixteen grams (0.5 equivalent) of sulfur is added to the reaction vessel. The reaction temperature is maintained at 100–120° C. for four hours. Infrared analysis indicates the presence of a band at 1036 $cm^{-1}$. The product is stripped to 120° C. and 15 mm Hg. The residue is filtered through diatomceous earth. The filtrate is the desired product and contains 13.7% sulfur.

Basic Nitrogen Compounds

As discussed above, the composition may contain a basic nitrogen compound. Typically the basic nitrogen compound is an amine, such as those discussed below, or a basic acylated amine. Typically, the basic nitrogen compound has a total base number of at least about 30 TBN, or preferably at least about 40 TBN, more preferably at least about 50 TBN. The basic nitrogen compounds generally have a maximum TBN of about 2500, preferably about 2000. In one embodiment, the basic nitrogen compound has a TBN from about 30 to about 2000, preferably from about 60 up to about 1500, or more preferably from about 80 up to about 1000. The TBN is based on neat chemical. In one embodiment, the lubricating composition contains at least about 0.07% by weight nitrogen.

In one embodiment, the basic nitrogen compound is a fatty amine. Fatty amines are those containing from about 8 to about 30, or from about 12 to about 24 carbon atoms. The fatty amines include n-octylamine, n-decylamine, n-dodecylamine, n-tetradecylamine, n-hexadecylamine, n-octadecylamine, stearylamine, oleyamine, tallowamine, soyaamine, etc. Also useful fatty amines include commercially available fatty amines such as "Armeen" amines (products available from Akzo Chemicals, Chicago, Ill.), such as Akzo's Armeen C, Armeen O, Armeen OL, Armeen T, Armeen HT, Armeen S and Armeen SD, wherein the letter designation relates to the fatty group, such as cocoa, oleyl, tallow, or stearyl groups.

Other useful basic nitrogen compounds include primary ether amines, such as those represented by the formula, $R_1(OR_2)_x—NH_2$ (I), wherein $R_1$ is a hydrocarbyl group from about 1 to about 150, or from 5 to about 24 carbon atoms, $R_2$ is a divalent alkylene group having about 2 to about 6 carbon atoms; and x is a number from one to about 150, or from about one to about five, or one. An example of an ether amine is available under the name SURFAM® amines produced and marketed by Mars Chemical Company, Atlanta, Ga. Etheramines include those identified as SURFAM P14B (decyloxypropylamine), SURFAM P16A (linear $C_{16}$), and SURFAM P17B (tridecyloxypropylamine). The carbon chain lengths (i.e., $C_{14}$, etc.) of the SURFAMS described above and used hereinafter are approximate and include the oxygen ether linkage.

In another embodiment, the basic nitrogen compound is a tertiary-aliphatic primary amine. Generally, the aliphatic group, and in one embodiment an alkyl group, contains from about 4 to about 30, or from about 6 to about 24, or from about 8 to about 22 carbon atoms. Usually the tertiary alkyl primary amines are monoamines represented by the formula $R_1—C(R_2)2-NH_2$ (II), wherein $R_1$ is a hydrocarbyl group containing from 1 to about 28 carbon atoms and $R_2$ is a divalent hydrocarbylene group, preferably an alkylene group, containing from 1 to about 12 carbon atoms. Such amines are illustrated by tert-butylamine, tert-hexylamine, 1-methyl-1-amino-cyclohexane, tert-octylamine, tert-decylamine, tert-dodecylamine, tert-tetradecylamine,tert-hexadecylamine,tert-octadecylamine,tert-tetracosanylamine, and tert-octacosanylamine.

Mixtures of amines are also useful for the purposes of this invention. Illustrative of amine mixtures of this type are "Primene 81R" which is a mixture of $C_{11}$–$C_{14}$ tertiary alkyl primary amines and "Primene JMT" which is a mixture of $C_{18}$–$C_{22}$ tertiary alkyl primary amines (both are available from Rohm and Haas Company). The tertiary alkyl primary amines and methods for their preparation are known to those of ordinary skill in the art. The tertiary alkyl primary amine useful for the purposes of this invention and methods for their preparation are described in U.S. Pat. No. 2,945,749, which is hereby incorporated by reference for its teaching in this regard.

In another embodiment, the basic nitrogen compound is a basic acylated amine. The basic acylated amine includes reaction products of one or more carboxylic acylating agent and one or more amine, preferably a polyamine. The basic acylated amines are prepared by reacting an excess of amine with the carboxylic acylating agent. In one embodiment, greater than one equivalent of amine is reacted with each equivalent of earboxylic group of the acylating agent. The equivalents of the amine is based on the number of nitrogen atoms in the amine. The equivalent weight of the carboxylic acylating agent is based on the number of carboxylic groups (e.g. COO), such as acids, lower esters, etc. in each acylating agent. In one embodiment, at least about 1.2, preferably at least about 1.4 equivalents of amine are reacted with each equivalent of carboxylic group of the acylating agent. Typically, up to about 8, or preferably up to about 6, or more preferably up to about 4 equivalents of amine are reacted with each equivalent of carboxylic group of the acylating agent.

The basic acylated amines are prepared from one or more amines and one or more carboxylic acylating agents. The carboxylic acylating agents include fatty acids, isoaliphatic acids, dimer acids, addition dicarboxylic acids, trimer acids, addition tricarboxylic acids, and hydrocarbyl substituted carboxylic acylating agents. In one embodiment, the carboxylic acylating agent is one of the above described unsaturated fatty acids. The fatty acids may also be the saturated analogs of the unsaturated fatty acids.

In another embodiment, the carboxylic acylating agents include isoaliphatic acids. Such acids contain a principal saturated, aliphatic chain typically having from about 14 to about 20 carbon atoms and at least one, but usually no more than about four, pendant acyclic lower alkyl groups. Specific examples of such isoaliphatic acids include 10-methyl-tetradecanoic acid, 3-ethyl-hexadecanoic acid, and 8-methyl-octadecanoic acid. The isoaliphatic acids include branched-chain acids prepared by oligomerization of commercial fatty acids, such as oleic, linoleic and tall oil fatty acids.

The dimer acids include products resulting from the dimerization of unsaturated fatty acids and generally contain an average from about 18 to about 44, or from about 28 to about 40 carbon atoms. Dimer acids are described in U.S. Pat. Nos. 2,482,760, 2,482,761, 2,731,481, 2,793,219, 2,964,545, 2,978,468, 3,157,681, and 3,256,304, the entire disclosures of which are incorporated herein by reference.

In another embodiment, the carboxylic acylating agents are addition carboxylic acylating agents, which are addition (4+2 and 2+2) products of an unsaturated fatty acid, such as tall oil acids and oleic acids, with one or more unsaturated carboxylic reagents, which are described below. These acids are taught in U.S. Pat. No. 2,444,328, the disclosure of which is incorporated herein by reference.

In another embodiment, the carboxylic acylating agent is a tricarboxylic acylating agent. Examples of tricarboxylic acylating agents include trimer acylating agents and the reaction product of an unsaturated carboxylic acylating agent (such as unsaturated fatty acids) and an alpha,beta-unsaturated dicarboxylic acylating agent (such as maleic, itaconic, and citraconic acylating agents, preferably maleic acylating agents). These acylating agents generally contain an average from about 18, or about 30, or about 36 to about 66, or to about 60 carbon atoms. The trimer acylating agents are prepared by the trimerization of one or more of the above-described fatty acids. In one embodiment, the tricarboxylic acylating agent is the reaction product of one or more unsaturated carboxylic acylating agent, such as an unsaturated fatty acid or unsaturated alkenyl succinic anhydride and an alpha,beta-unsaturated carboxylic reagent. The unsaturated carboxylic reagents include unsaturated carboxylic acids per se and functional derivatives thereof, such as anhydrides, esters, amides, imides, salts, acyl halides, and nitriles. The unsaturated carboxylic reagent include mono, di, tri or tetracarboxylic reagents. Specific examples of useful mono-basic unsaturated carboxylic acids are acrylic acid, methacrylic acid, cinnamic acid, crotonic acid, 2-phenylpropenoic acid, etc. Exemplary polybasic acids include maleic acid, maleic anhydride, fumaric acid, mesaconic acid, itaconic acid and citraconic acid. Generally, the unsaturated carboxylic reagent is maleic anhydride, acid or lower ester, e.g. those containing less than eight carbon atoms. In one embodiment, the unsaturated dicarboxylic acylating agent generally contains an average from about 12 up to about 40, or from about 18 up to about 30 carbon atoms. Examples of these tricarboxylic acylating agents include Empol® 1040 available commercially from Emery Industries, Hystrene® 5460 available commercially from Humko Chemical, and Unidyme® 60 available commercially from Union Camp Corporation.

In another embodiment, the carboxylic acylating agent is a hydrocarbyl substituted carboxylic acylating agent. The hydrocarbyl substituted carboxylic acylating agents are prepared by a reaction of one or more olefin or polyalkene with one or more of the above described unsaturated carboxylic reagents. The hydrocarbyl group generally contains from about 8 to about 300, or from about 12 up to about 200, or from about 16 up to about 150, or from about 30 to about 100 carbon atoms. In one embodiment, the hydrocarbyl group contains from about 8 up to about 40, or from about 10 up to about 30, or from about 12 up to about 24 carbon atoms. In one embodiment, the hydrocarbyl group may be derived from an olefin. The olefins typically contain from about 3 to about 40, or from about 4 to about 24 carbon atoms. These olefins are preferably alpha-olefins (sometimes referred to as mono-1-olefins or terminal olefins) or isomerized alpha-olefins. Examples of the alpha-olefins include 1-octene, 1-nonene, 1-decene, 1-dodecene, 1-tridecene, 1-tetradecene, 1-pentadecene, 1-hexadecene, 1-heptadecene, 1-octadecene, 1-nonadecene, 1-eicosene, 1-heneicosene, 1-docosene, 1-tetracosene, etc. Commercially available alpha-olefin fractions that can be used include the $C_{15-18}$alpha-olefins, $C_{12}$–$C_{16}$ alpha-olefins, $C_{14-16}$ alpha-olefins, $C_{14-18}$ alpha-olefins, $C_{16-18}$ alpha-olefins, $C_{16-20}$ alpha-olefins, $C_{18-24}$ alpha-olefins, $C_{22-28}$ alpha-olefins, etc.

In another embodiment, the hydrocarbyl group is derived from a polyalkene. The polyalkene includes homopolymers and interpolymers of polymerizable olefin monomers having from 2 up to about 16, or from 2 up to about 6, or from 2 to about 4 carbon atoms. The olefins may be monoolefins, such as ethylene, propylene, 1-butene, isobutene, and 1-octene, or polyolefinic monomers, including diolefinic monomers, such 1,3-butadiene and isoprene. The olefins also may be one or more of the above described alpha-olefins. In one embodiment, the interpolymer is a homopolymer. In one embodiment, the homopolymer is a polybutene, such as a polybutene in which about 50% of the polymer is derived from butylene. The polyalkenes are prepared by conventional procedures. In one embodiment, the polyalkene is characterized as containing from about 8 up to about 300, or from about 30 up to about 200, or from about 35 up to about 100 carbon atoms. In one embodiment, the polyalkene is characterieed by an $\overline{M}n$ (number average molecular weight) of at least about 400 or at least about 500. Generally, the polyalkene is characterized by having an $\overline{M}n$ from about 500 up to about 5000, or from about 700 up to about 3000, or from about 800 up to 2500, or from about 900 up to about 2000. In another embodiment, $\overline{M}n$ varies from about 500 up to about 1500, or from about 700 up to about 1300, or from about 800 up to about 1200.

The abbreviation $\overline{M}n$ is the conventional symbol representing number average molecular weight. Gel permeation chromatography (GPC) is a method which provides both weight average and number average molecular weights as well as the entire molecular weight distribution of the polymers. For purpose of this invention a series of fractionated polymers of isobutene, polyisobutene, is used as the calibration standard in the GPC. The techniques for determining $\overline{M}n$ and $\overline{M}w$ values of polymers are well known and are described in numerous books and articles. For example, methods for the determination of $\overline{M}n$ and molecular weight distribution of polymers is described in W. W. Yan, J. J. Kirkland and D. D. Bly, "Modern Size Exclusion Liquid Chromatographs", J. Wiley & Sons, Inc., 1979.

In another embodiment, the polyalkenes have a $\overline{M}n$ from at least about 1300, or from about 1500, or from about 1700. In one embodiment, the polyalkenes have a $\overline{M}n$ from about 1500 up to about 3200, or from about 1500 up to about 2800, or from about 1500 up to about 2400. In a preferred embodiment, the polyalkene has a $\overline{M}n$ from about 1700 to about 2400. The polyalkenes also generally have a $\overline{M}w/\overline{M}n$ from about 1.5 to about 4, or from about 1.8 to about 3.6, or from about 2.0 to about 3.4, or from about 2.5 to about 3.2. The hydrocarby substituted carboxylic acylating agents are described in U.S. Pat. Nos. 3,219,666 and 4,234,435, the disclosures of which is hereby incorporated by reference.

In another embodiment, the acylating agents may be prepared by reacting one or more of the above described polyalkenes with an excess of maleic anhydride to provide substituted succinic acylating agents wherein the number of succinic groups for each equivalent weight of substituent group, i.e., polyalkenyl group, is at least about 1.3, preferably at least about 1.4, or more preferably at least about 1.5. The maximum number will generally not exceed about 4.5, or preferably about 3.5. A suitable range is from about 1.4 up to about 3.5, or from about 1.5 up to about 2.5 succinic groups per equivalent weight of substituent groups.

The carboxylic acylating agents are known in the art and have been described in detail, for example, in the following: U.S. Pat. No. 3,215,707 (Rense); U.S. Pat. No. 3,219,666 (Norman et al); U.S. Pat. No. 3,231,587 (Rense); U.S. Pat. No. 3,912,764 (Palmer); U.S. Pat. No. 4,110,349 (Cohen); and U.S. Pat. No. 4,234,435 (Meinhardt et al); and U.K. 1,440,219. The disclosures of these patents are hereby incorporated by reference. These patents are incorporated herein by reference for their disclosure of carboxylic acylating agents and methods for making the same.

The above-described carboxylic acylating agents are reacted with amines to form the basic acylated amines. The amines may be monoamines or polyamines. Useful amines include those amines disclosed in U.S. Pat. No. 4,234,435 at Col. 21, line 4 to Col. 27, line 50, these passages being incorporated herein by reference. The amines may be any of the above described amines, preferably the amine is a polyamine, such as an alkylenepolyamine or a condensed amine.

In another embodiment, the polyamine is a fatty diamine. The fatty diamines include mono- or dialkyl, symmetrical or asymmetrical ethylenediamines, propanediamines (1,2, or 1,3), and polyamine analogs of the above. Suitable commercial fatty polyamines are Duomeen C (N-coco-1,3-diaminopropane), Duomeen S (N-soya-1,3-diaminopropane), Duomeen T (N-tallow-1,3-diaminopropane), and Duomeen O (N-oleyl-1,3-diaminopropane). "Duomeens" are commercially available from Armak Chemical Co., Chicago, Ill.

In another embodiment, the polyamines are polyoxyalkylene polyamines, e.g. polyoxyalkylene diamines and polyoxyalkylene triamines, having average molecular weights ranging from about 200 to about 4000, or from about 400 to about 2000. The preferred polyoxyalkylene polyamines include the polyoxyethylene and polyoxypropylene diamines and the polyoxypropylene triamines. The polyoxyalkylene polyamines are commercially available and may be obtained, for example, from the Texaco Chemical Company, Inc. under the trade name "Jeffamines D-230, D-400, D-1000, D-2000, T-403, etc.". U.S. Pat. Nos. 3,804,763 and 3,948,800 are expressly incorporated herein by reference for their disclosure of such polyoxyalkylene polyamines and acylated products made therefrom.

In another embodiment, the polyamines are hydroxy-containing polyamines. Hydroxy-containing polyamine analogs of hydroxy monoamines, particularly alkoxylated alkylenepolyamines, e.g., N,N'-(dihydroxyethyl)ethylene diamines can also be used. Such polyamines can be made by reacting the above-described alkylene amines with one or more of the above-described alkylene oxides. Similar alkylene oxide-alkanol amine reaction products may also be used such as the products made by reacting the above described primary, secondary or tertiary alkanol amines with ethylene, propylene or higher epoxide in a 1.1 to 1.2 molar ratio. Reactant ratios and temperatures for carrying out such reactions are known to those skilled in the art. Specific examples of hydroxy-containing polyamines include N-(2-hydroxyethyl)ethylenediamine, N,N'-bis(2-hydroxyethyl) ethylenediamine, 1-(2-hydroxyethyl)piperazine, mono (hydroxypropyl)-substituted tetraethylene-pentamine, N-(3-hydroxybutyl)tetramethylenediamine, etc. Higher homologs obtained by condensation of the above illustrated hydroxy-containing polyamines through amino groups or through hydroxy groups are likewise useful. Condensation through amino groups results in a higher amine accompanied by removal of ammonia, while condensation through the hydroxy groups results in products containing ether linkages accompanied by removal of water. Mixtures of two or more of any of the above described polyamines are also useful.

In another embodiment, the polyamine is a heterocyclic polyamine. The heterocyclic polyamines include aziridines, azetidines, azolidines, tetra- and dihydropyridines, pyrroles, indoles, piperidines, imidazoles, di- and tetrahydroimidazoles, piperazines, isoindoles, purines, morpholines, thiomorpholines, N-aminoalkylmorpholines, N-aminoalkylthiomorpholines, N-aminoalkylpiperazines, N,N'-diaminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl substituted piperidines, piperazine, aminoalkyl substituted piperazines, morpholine, aminoalkyl substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperzine, and N,N'-diaminoethylpiperazine. Hydroxy heterocyclic polyamines may be used and include N-(2-hydroxyethyl)cyclohexylamine, 3-hydroxycyclopentylamine, parahydroxyaniline, N-hydroxyethylpiperazine, and the like.

The amine used in preparing the acylated amine may be an alkylenepolyamine. Alkylenepolyamines are represented by the formula $H(R_1)N\text{-}(Alkylene\text{-}N)_n\text{—}(R_1)_2$ (III), wherein each $R_1$ is independently hydrogen; or an aliphatic or hydroxy-substituted aliphatic group of up to about 30 carbon atoms; n is a number from 1 to about 10, or from about 2 to about 7, or from about 2 to about 5; and the "Alkylene" group has from 1 to about 10 carbon atoms, or from about 2 to about 6, or from about 2 to about 4. In another embodiment, $R_1$ is independently a hydrocarbyl group having from one to about eight carbon atoms or hydroxyhydrocarbyl group having from one to about eight carbon atoms, or from one to about four. Such alkylenepolyamines include methylenepolyamines, ethylenepolyamines, butylenepolyamines, propylenepolyamines, pentylenepolyamines, etc. The higher homologs and related heterocyclic amines, such as piperazines and N-amino alkyl-substituted piperazines, are also included. Specific examples of such polyamines are ethylenediamine, triethylenetetramine, tris-(2-aminoethyl)amine, propylenediamine, trimethylenediamine, tripropylenetetramine, triethylenetetraamine, tetraethylenepentamine, hexaethyleneheptamine, pentaethylenehexamine, etc. Higher homologs obtained by condensing two or more of the above-noted alkyleneamines are similarly useful as are mixtures of two or more of the aforedescribed polyamines.

In one embodiment, the polyamine is an ethylenepolyamine. Such polyamines are described in detail under the heading Ethylene Amines in Kirk Othmer's "Encyclopedia of Chemical Technology", 2d Edition, Vol. 7, pages 22–37, Interscience Publishers, New York (1965). Ethylenepolyamines are often a complex mixture of polyalkylenepolyamines including cyclic condensation products. Other useful types of polyamine mixtures are those resulting from stripping of the above-described polyamine mixtures to leave, as residue, what is often termed "polyamine bottoms". In general, alkylenepolyamine bottoms can be characterized as having less than 2%, usually less than 1% (by weight) material boiling below about 200° C. A typical sample of such ethylenepolyamine bottoms obtained from the Dow Chemical Company of Freeport, Tex. designated "E-100" has a specific gravity at 15.6° C. of 1.0168, a percent nitrogen by weight of 33.15 and a viscosity at 40° C. of 121 centistokes. Gas chromatography analysis of such a sample contains about 0.93% "Light Ends" (most probably diethylenetriamine), 0.72% triethylenetetraamine, 21.74% tetraethylenepentaamine and 76.61% pentaethylenehexamine and higher analogs. These alkylenepolyamine bottoms include cyclic condensation products such as piperazine and higher analogs of diethylenetriamine, triethylenetetramine and the like. These alkylenepolyamine bottoms may be reacted solely with the acylating agent or they may be used with other amines, polyamines, or mixtures thereof.

Another useful polyamine is a condensation reaction between at least one hydroxy compound with at least one polyamine reactant containing at least one primary or secondary amino group. The hydroxy compounds are preferably polyhydric alcohols and amines. The polyhydric alcohols are described below. In one embodiment, the hydroxy compounds are polyhydric amines. Polyhydric amines include any of the above-described monoamines reacted with an alkylene oxide (e.g., ethylene oxide, propylene oxide, butylene oxide, etc.) having from two to about 20 carbon atoms, or from two to about four. Examples of polyhydric amines include diethanolamine, triethanolamine, tri-(hydroxypropyl)amine, tris-(hydroxymethyl)amino methane, 2-amino-2-methyl-1,3-propanediol, N,N,N',N'-tetrakis(2-hydroxypropyl)ethylenediamine, and N,N,N',N'-tetrakis(2-hydroxyethyl)ethylenediamine, preferably tris (hydroxymethyl)aminomethane (THAM).

Polyamines which may react with the polyhydric alcohol or amine to form the condensation products or condensed amines, are described above. Preferred polyamines include triethylenetetramine (TETA), tetraethylenepentamine (TETA), pentaethylenehexamine (PEHA), and mixtures of polyamines such as the above-described "amine bottoms". The condensation reaction of the polyamine reactant with the hydroxy compound is conducted at an elevated temperature, usually from about 60° C. to about 265° C., or from about 220° C. to about 250° C. in the presence of an acid catalyst.

The amine condensates and methods of making the same are described in PCT publication WO86/05501 and U.S. Pat. No. 5,230,714 (Steckel) which are incorporated by reference for its disclosure to the condensates and methods of making. A particularly useful amine condensate is prepared from HPA Taft Amines (amine bottoms available commercially from Union Carbide Co. with typically 34.1% by weight nitrogen and a nitrogen distribution of 12.3% by weight primary amine, 14.4% by weight secondary amine and 7.4% by weight tertiary amine), and tris(hydroxymethyl) aminomethane (THAM).

Acylated amines and methods for preparing the same are described in U.S. Pat. Nos. 3,219,666; 4,234,435; 4,952,328; 4,938,881; 4,957,649; and 4,904,401. The disclosures of acylated nitrogen dispersants and other dispersants contained in those patents are hereby incorporated by reference.

The following Examples relate to basic nitrogen containing compounds and methods of preparing the same.

EXAMPLE N-1

A polyisobutenyl (Mn=850) succinic anhydride having an acid number of 113 (corresponding to an equivalent weight of 500). To a mixture of 500 grams (1 equivalent) of this polyisobutenyl succinic anhydride and 160 grams of toluene there is added at room temperature 55.5 grams (1.5 equivalents) of an ethylene amine mixture having a composition corresponding to that of triethylenetetramine. The addition is made portionwise throughout a period of 15 minutes. The mixture then is heated and a water-toluene azeotrope distilled from the mixture. When no more water would distill the mixture is heated to 150° C. at reduced pressure to remove the toluene. The residue is diluted with 350 grams of mineral oil. The resulting product has a nitrogen content of 1.9%.

EXAMPLE N-2

The procedure of Example N-1 is repeated using 55.0 grams (1.5 equivalents) of triethylenetetramine as the amine reactant. The resulting product has a nitrogen content of 2.9%.

EXAMPLE N-3

A mixture of 86.4 grams of an alkylenepolyamine mixture, comprising 80% of ethylene polyamine bottoms from Union Carbide and 20% of a commercial mixture of ethylenepolyamines corresponding in empirical formula to diethylenetriamine, and 390 grams of 100 neutral mineral oil is heated to 100° C. under nitrogen. To this mixture is added 800 grams of polybutenyl (Mn=1000) substituted succinic anhydride and 200 grams of 100 neutral mineral oil. The reaction mixture is heated to 290–300° F. and the temperature is maintained for one hour, with submerged nitrogen blowing. The reaction product is then filtered and the filtrate is the desired product. The desired product is a 40% oil mixture having 2% nitrogen, and a 45 TBN.

EXAMPLE N-4

To a mixture of 140 grams of toluene and 400 grams (0.78 equivalent) of a polyisobutenyl (Mn=850) succinic anhydride, having an acid number of 109, there is added at room temperature 63.6 grams (1.55 equivalents) of an ethyleneamine mixture having an average composition corresponding to that of tetraethylenepentamine and available from Union Carbide under the trade name "Polyamine H." The mixture is heated to distill the water-toluene azeotrope and then to 150° C. at reduced pressure to remove the remaining toluene. The residual polyamide has a nitrogen content of 4.7%.

EXAMPLE N-5

Following the procedure of Example N-3, 116 grams of the polyamine mixture of Example N-3 and 388 grams of 100 neutral mineral oil are reacted with 800 grams of the polybutenyl succinic anhydride of Example N-3 and 200 grams of a 100 neutral mineral oil. The desired product is a 40% oil mixture having 2.5% nitrogen and a 70 TBN.

EXAMPLE N-6

The procedure of Example N-1 is repeated using 46 grams (1.5 equivalents) of ethylene diamine as the amine reactant. The product which resulted has a nitrogen content of 1.5%.

EXAMPLE N-7

A reaction vessel is charged with 1000 grams of the polybutenyl succinic anhydride of Example N-3 and 400 grams of 100 neutral mineral oil. The mixture is heated to 88° C. where 152 grams of a polyamine prepared from: 1299 grams of HPA Taft Amines (amine bottoms available commercially from Union Carbide Co. with typically 34.1% by weight nitrogen and a nitrogen distribution of 12.3% by weight primary amine, 14.4% by weight secondary amine and 7.4% by weight tertiary amine), 727 grams of 40% aqueous tris(hydroxymethyl)aminomethane (THAM), and 23 grams of 85% $H_3PO_4$ which are heated to 120° C. over 0.6 hour, then are heated to 150° C. over 1.25 hour, then to 235° C. over 1 hour, then the temperature is maintained at 230–235° C. for 5 hours, then heated to 240° C. over 0.75 hour and then held at 240–245° C. for 5 hours, followed by filtration through diatomaceous earth. The mixture is heated to 152° C. over 5.5 hours. At temperature, the reaction mixture is blown subsurface with nitrogen until the percent water is a maximum of 0.3. Diluent oil (342 grams of 100 neutral mineral oil) is added to the reaction mixture and the reaction mixture is filtered through diatomaceous earth. The filtrate is the desired product. The desired product is a 40% oil mixture having 2.1% nitrogen and a 48 TBN.

EXAMPLE N-8

An acid producing compound is prepared by heating chloromaleic anhydride (1 equivalent) and 1 equivalent of a chlorinated polyisobutene having a chorine content of 4% and a molecular weight of 2500 at 150°–200° C. The product of the reaction is then mixed with tetraethylenepentamine (2.5 equivalents) at 50° C. and the mixture is heated at 180°–210° C. to form an acylated polyamine.

Hydrocarbyl Mercaptans (B)

As described above, the lubricants and/or functional fluids contain a hydrocarbyl mercaptan. The hydrocarbyl mercaptans are compounds represented by the formula RSH (IV), wherein R is a hydrocarbyl group. In one embodiment, R is an alkyl, an alkenyl, cycloalkyl, or cycloalkenyl group. R may also be a haloalkyl, hydoxyalkyl, or hydroxyalkyl substituted (e.g. hydroxymethyl, hydroxyethyl, etc.) aliphatic groups. R generally contains from about 8 to about 30 carbon atoms, preferably from about 8 to about 18 carbon atoms. Examples include octyl mercaptan, 6-hydroxymethyl-octanethiol, 8-chloro-nonanethiol, nonyl mercaptan, decyl mercaptan, 10-amino-dodecanethiol, dodecyl mercaptan, 10-hydroxymethyl-tetradecanethiol, tetradecyl mercaptan, hexadecyl mercaptan, and octadecyl mercaptan. In one embodiment the hydrocarbyl group is free of one or more ether, thioether, carboxylic acid, carboxylic ester, or hydroxy groups.

These mercaptans are present in an amount sufficient enough to extend the life of elastomeric seals (e.g., nitrile, polyacrylate, silicone, ethylene acrylic and fluoroelastomers seals). The term extending seal life refers to an increase in time that the seal is useful at a given operating temperature. Generally, these mercaptans are present in an amount from about 0.01% to about 5% by weight, preferably from about 0.03% to about 4%, more preferably from about 0.05% to about 3% by weight. In one embodiment, such as in a crankcase oil, the hydrocarbyl mercaptan is used in an amount from about 0.01% up to about 2%, or from about 0.03% up to about 1.5%, or from about 0.4% up to about 1% by weight. In another embodiment, such as in driveline fluids, including gear oils and transmission fluids, the hydrocarbyl mercaptan is used in an amount from about 0.5% up to about 5%, or from about 0.75% up to about 4%, and from about 1% up to about 3.5% by weight.

In one embodiment, the hydrocarbyl mercaptan is used in combination with a sulfolene seal swell agent. Typically the sulfolene is used in an amount from about 0.01% up to about 1%, or from about 0.05% up to about 0.8%, or from about 0.09% up to about 0.5% by weight. U.S. Pat. No. 4,029,587, issued to Koch, describes substituted sulfolenes useful as seal swell agents. This patent is incorporated by references for such disclosure.

As described above the lubricant or functional fluid comprises (A) an antiwear or extreme pressure agent containing sulfur and/or a basic nitrogen compound and (B) a hydrocarbyl mercaptan. When (A) is an organic polysulfide, then the lubricant or functional fluid contains (C) a phosphorus antiwear or extreme pressure agent, an overbased composition, or a mixture thereof, wherein (C) is different from (A).

Phosphorus-Containing Antiwear or Extreme Pressure Agents (C)

The phosphorus containing antiwear or extreme pressure agent is typically present in an amount up to about 20% by weight, preferably up to about 10% by weight of the lubricant or functional fluid. Typically, the phosphorus containing antiwear/extreme pressure agent is present in the lubricants and functional fluids at a level from about 0.01% up to about 10%, or from about 0.05% or up to about 4%, or from about 0.08% up to about 3% or from 0.1% to about 2% by weight.

The phosphorus-containing antiwear or extreme pressure agent (C) can be a phosphorus acid ester or salt thereof, a phosphite, or a phosphorus-containing carboxylic acid, ester, ether or amide. The phosphorus acids include phosphoric acids, phosphonic acids, phosphinic acids, and thiophosphoric acids, including dithiophosphoric acid as well as the monothiophosphoric acid, thiophosphinic acids, and thiophosphonic acids. When the sulfur containing antiwear or extreme pressure agent (A) is a metal thiophosphate, the phosphorus containing antiwear or extreme pressure agent (C) is different from (A).

In one embodiment, the phosphorus containing antiwear or extreme pressure agents (C) is a phosphorus acid ester. The ester is prepared by reacting one or more phosphorus acids or anhydrides with an alcohol containing from one to about 30, or from two to about 24, or from about 3 to about 12 carbon atoms. The alcohols used to prepare the phosphorus acid esters include those described above for metal thiophosphates. The phosphorus acid or anhydride is generally an inorganic phosphorus reagent, such as phosphorus pentoxide, phosphorus trioxide, phosphorus tetroxide, phosphorous acid, phosphoric acid, phosphorus halide, $C_{1-7}$ phosphorus esters, or a phosphorus sulfide which includes phosphorus pentasulfide, phosphorus sesquisulfide, phosphorus heptasulfide and the like. In one embodiment, the phosphorus acid is a thiophosphorus acid or salt thereof. The thiophosphoric acids and their salts are described above. Examples of phosphorus acid esters include phosphoric acid di- and tri-esters prepared by reacting a phosphoric acid or anhydride with cresol alcohols, e.g. tricresylphosphate.

In one embodiment, the phosphorus containing antiwear or extreme pressure agent (C) is a phosphorus ester prepared by reacting one or more dithiophosphoric acid with an epoxide or a glycol. This reaction product may be used alone, or further reacted with a phosphorus acid, anhydride, or lower ester. The epoxide is generally an aliphatic epoxide or a styrene oxide. Examples of useful epoxides include ethylene oxide, propylene oxide, butene oxide, octene oxide, dodecene oxide, styrene oxide, etc. Propylene oxide is preferred. The glycols may be aliphatic glycols, having from 1 to about 12, or from about 2 to about 6, or from about 2 to about 3 carbon atoms, or aromatic glycols. Glycols include ethylene glycol, propylene glycol, catechol, resorcinol, and the like. The dithiophosphoric acids, glycols, epoxides, inorganic phosphorus reagents and methods of reacting the same are described in U.S. Pat. Nos. 3,197,405 and 3,544,465 which are incorporated herein by reference for their disclosure to these.

The following Examples P-1 and P-2 exemplify the preparation of useful phosphorus acid esters.

EXAMPLE P-1

Phosphorus pentoxide (64 grams) is added at 58° C. over a period of 45 minutes to 514 grams of hydroxypropyl O,O-di(4-methyl-2-pentyl)phosphorodithioate (prepared by reacting di(4-methyl-2-pentyl)-phosphorodithioic acid with 1.3 moles of propylene oxide at 25° C.). The mixture is heated at 75° C. for 2.5 hours, mixed with a diatomaceous earth and filtered at 70° C. The filtrate contains 11.8% by weight phosphorus, 15.2% by weight sulfur, and has an acid number of 87 (bromophenol blue).

EXAMPLE P-2

A mixture of 667 grams of phosphorus pentoxide and the reaction product of 3514 grams of diisopropyl phosphorodithioic acid with 986 grams of propylene oxide at 50° C. is heated at 85° C. for 3 hours and filtered. The filtrate contains 15.3% by weight phosphorus, 19.6% by weight sulfur, and has an acid number of 126 (bromophenol blue).

Acidic phosphoric acid esters may be reacted with ammonia, an amine, or metallic base to form an amine or metal salt. The salts may be formed separately and then the salt of the phosphorus acid ester may be added to the lubricating composition. Alternatively, the salts may also be formed in situ when the acidic phosphorus acid ester is blended with other components to form a fully formulated lubricating composition. When the phosphorus acid esters are acidic, they may be reacted with ammonia, amine, or metallic base to form the corresponding ammonia, amine, or metal salt. The salts may be formed separately and then the salt of the phosphorus acid ester is added to the lubricating or functional fluid composition. Alternatively, the salts may also be formed when the phosphorus acid ester is blended with other components to form the lubricating or functional fluid composition. The phosphorus acid ester could then form salts with basic materials which are in the lubricating composition or functional fluid composition such as basic nitrogen containing compounds (e.g., acylated amines) and overbased materials.

The amine salts of the phosphorus acid esters may be formed from ammonia, or a primary, secondary or tertiary amine, or mixtures thereof. These amines can be monoamines or polyamines. Useful amines include those disclosed in U.S. Pat. No. 4,234,435 at Col. 21, line 4 to Col. 27, line 50, this section of this reference being incorporated herein by reference.

The monoamines generally contain from 1 to about 24 carbon atoms, with from 1 to about 12 carbon atoms being preferred, with from 1 to about 6 being more preferred. Examples of monoamines include methylamine, ethylamine, propylamine, butylarine, octylamine, and dodecylamine. Examples of secondary amines include dimethylamine, diethylamine, dipropylamine, dibutylamine, methylbutylamine, ethylhexylamine, etc. Tertiary amines include trimethylamine, tributylamine, methyldiethylamine, ethyldibutylamine, etc.

In one embodiment, the amine may be a hydroxyamine. Typically, the hydroxyamines are primary, secondary or tertiary alkanol amines or mixtures thereof. Such amines can be represented by the formulae: $H_2$—N—R'—OH (V), $H(R'_1)$N—R'—OH (VI), and $(R'_1)_2$—N—R'—OH (VII), wherein each $R'_1$ is independently a hydrocarbyl group having from one to about eight carbon atoms or hydroxyhydrocarbyl group having from one to about eight carbon atoms, or from one to about four, and R' is a divalent hydrocarbyl group of about two to about 18 carbon atoms, or from two to about four. The group —R'—OH in such formulae represents the hydroxyhydrocarbyl group. R' can be an acyclic, alicyclic or aromatic group. Typically, R' is an acyclic straight or branched alkylene group such as an ethylene, 1,2-propylene, 1,2-butylene, 1,2-octadecylene, etc. group. Where two $R'_1$ groups are present in the same molecule they can be joined by a direct carbon-to-carbon bond or through a heteroatom (e.g., oxygen, nitrogen or sulfur) to form a 5-, 6-, 7- or 8-membered ring structure. Examples of such heterocyclic amines include N-(hydroxyl lower alkyl)-morpholines, -thiomorpholines, -piperidines, -oxazolidines, -thiazolidines and the like. Typically, however, each $R'_1$ is independently a methyl, ethyl, propyl, butyl, pentyl or hexyl group. Examples of these alkanolamines include mono-, di-, and triethanolamine, diethylethanolamine, ethylethanolamine, butyldiethanolamine, etc.

The hydroxyamines may also be an ether N-(hydroxyhydrocarbyl)amine. These are hydroxypoly (hydrocarbyloxy) analogs of the above-described hydroxyamines (these analogs also include hydroxyl-substituted oxyalkylene analogs). Such N-(hydroxyhydrocarbyl)amines can be conveniently prepared by reaction of one or more of the above epoxides with aforedescribed amines and may be represented by the formulae: $H_2N(R'O)_x$—H (VIII), $H(R'_1)$—N—$(R'O)_x$—H (IX), and $(R'_1)_2$—N—$(R'O)_x$—H (X), wherein x is a number from about 2 to about 15 and $R_1$ and R' are as described above. $R'_1$ may also be a hydroxypoly(hydrocarbyloxy) group.

In another embodiment, the amine is a hydroxyamine which may be represented by the formula

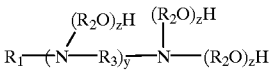

(XI)

wherein $R_1$ is a hydrocarbyl group containing from about 6 to about 30 carbon atoms; $R_2$ is an alkylene group having from about two to about twelve carbon atoms, preferably an ethylene or propylene group; $R_3$ is an alkylene group containing from 1 up to about 8, or from 1 up to about 5 carbon atoms; y is zero or one; and each z is independently a number from zero to about 10, with the proviso that at least one z is zero.

Useful hydroxyhydrocarbyl amines where y in the formula (XI) is zero include 2-hydroxyethylhexylamine; 2-hydroxyethyloctylamine; 2-hydroxyethylpentadecylamine; 2-hydroxyethyloleylamine; 2-hydroxyethylsoyamine; bis(2-hydroxyethyl)hexylamine; bis(2-hydroxyethyl)oleylamine; and mixtures thereof. Also included are the comparable members wherein in the above formula at least one z is at least 2, as for example, 2-hydroxyethoxyethylhexylamine.

In one embodiment, the amine may be a hydroxyhydrocarbyl amine, where referring to the above formula, y equals zero in formula (XI). These hydroxyhydrocarbyl amines are available from the Akzo Chemical Division of Akzona, Inc., Chicago, Ill., under the general trade designations "Ethomeen" and "Propomeen". Specific examples of such products include: Ethomeen C/15 which is an ethylene oxide condensate of a coconut fatty acid containing about 5 moles of ethylene oxide; Ethomeen C/20 and C/25 which are ethylene oxide condensation products from coconut fatty acid containing about 10 and 15 moles of ethylene oxide, respectively; Ethomeen O/12 which is an ethylene oxide condensation product of oleyl amine containing about 2 moles of ethylene oxide per mole of amine; Ethomeen S/15 and S/20 which are ethylene oxide condensation products with stearyl amine containing about 5 and 10 moles of ethylene oxide per mole of amine, respectively; Ethomeen T/12, T/15 and T/25 which are ethylene oxide condensation products of tallow amine containing about 2, 5 and 15 moles of ethylene oxide per mole of amine, respectively; and Propomeen O/12 which is the condensation product of one mole of oleyl amine with 2 moles propylene oxide.

The amine may also be a polyamine. The polyamines include alkoxylated diamines, fatty polyamine diamines, described above, alkylenepolyamines (described above), hydroxy containing polyamines, condensed polyamines, described above, and heterocyclic polyamines, described above. Commercially available examples of alkoxylated diamines include those amines where y in the formula (XI) is one. Examples of these amines include Ethoduomeen T/13 and T/20 which are ethylene oxide condensation products of N-tallowtrimethylenediamine containing 3 and 10 moles of ethylene oxide per mole of diamine, respectively.

The metal salts of the phosphorus acid esters are prepared by the reaction of a metal base with the phosphorus acid ester. The metal base may be any metal compound capable of forming a metal salt. Examples of metal bases include metal oxides, hydroxides, carbonates, sulfates, borates, or the like. The metals of the metal base include Group IA, IIA, IB through VIIB, and VIII metals (CAS version of the Periodic Table of the Elements). These metals include the alkali metals, alkaline earth metals and transition metals. In one embodiment, the metal is a Group IIA metal, such as calcium or magnesium, a Group IB metal, such as copper, a Group IIB metal, such as zinc, or a Group VIIB metal, such as manganese. Preferably the metal is magnesium, calcium, copper, or zinc. Examples of metal compounds which may be reacted with the phosphorus acid include zinc hydroxide, zinc oxide, copper hydroxide, copper oxide, etc.

In one embodiment, the phosphorus antiwear or extreme pressure agent (C) is a metal thiophosphate, preferably a metal dithiophosphate. The metal thiophosphates are described above. In another embodiment, the metal dithiophosphates are further reacted with one or more of the above described epoxides, preferably propylene oxide. These reaction products are described in U.S. Pat. Nos. 3,213,020; 3,213,021; and 3,213,022, issued to Hopkins et al. These patents are incorporated by reference for such description of the reaction products.

The following Examples P-3 to P-6 exemplify the preparation of useful phosphorus acid ester salts.

EXAMPLE P-3

A reaction vessel is charged with 217 grams of the filtrate from Example P-1. A commercial aliphatic primary amine (66 grams), having an average molecular weight of 191 in which the aliphatic radical is a mixture of tertiary alkyl radicals containing from 11 to 14 carbon atoms, is added over a period of 20 minutes at 25–60° C. The resulting product has a phosphorus content of 10.2% by weight, a nitrogen content of 1.5% by weight, and an acid number of 26.3.

EXAMPLE P-4

The filtrate of Example P-2 (1752 grams) is mixed at 25–82° C. with 764 grams of the aliphatic primary amine used in of Example P-3. The resulting product has 9.95% phosphorus, 2.72% nitrogen, and 12.6% sulfur.

EXAMPLE P-5

Phosphorus pentoxide (852 grams) is added to 2340 grams of iso-octyl alcohol over a period of 3 hours. The temperature increases from room temperature but is maintained below 65° C. After the addition is complete the reaction mixture is heated to 90° C. and the temperature is maintained for 3 hours. Diatomaceous earth is added to the mixture, and the mixture is filtered. The filtrate has 12.4% phosphorus, a 192 acid neutralization number (bromophenol blue) and a 290 acid neutralization number (phenolphthalein).

The above filtrate is mixed with 200 grams of toluene, 130 grams of mineral oil, 1 gram of acetic acid, 10 grams of water and 45 grams of zinc oxide. The mixture is heated to 60–70° C. under a pressure of 30 mm Hg. The resulting product mixture is filtered using a diatomaceous earth. The filtrate has 8.58% zinc and 7.03% phosphorus.

EXAMPLE P-6

Phosphorus pentoxide (208 grams) is added to the product prepared by reacting 280 grams of propylene oxide with 1184 grams of O,O'-diisobutylphosphorodithioic acid at 30–60° C. The addition is made at a temperature of 50–60° C. and the resulting mixture is then heated to 80° C. and held at that temperature for 2 hours. The commercial aliphatic primary amine identified in Example P-3 (384 grams) is added to the mixture, while the temperature is maintained in the range of 30–60° C. The reaction mixture is filtered through diatomaceous earth. The filtrate has 9.31% phosphorus, 11.37% sulfur, 2.50% nitrogen, and a base number of 6.9 (bromophenol blue indicator).

In another embodiment, phosphorus antiwear or extreme pressure agent (C) is a metal salt of (a) at least one dithiophosphoric acid and (b) at least one aliphatic or alicyclic carboxylic acid. The dithiophosphoric acids are described above. The carboxylic acid may be a monocarboxylic or polycarboxylic acid, usually containing from 1 to about 3, or just one carboxylic acid group. The preferred carboxylic acids are those having the formula RCOOH (XII), wherein R is a hydrocarbyl group, preferably free from acetylenic unsaturation. Generally, R contains from about 2 up to about 40, or from about 3 up to about 24, or from about 4 up to about 12 carbon atoms. In one embodiment, R contains from about 4, or from about 6 up to about 12, or up to about 8 carbon atoms. In one embodiment, R is an alkyl group. Suitable acids include the butanoic, pentanoic, hexanoic, octanoic, nonanoic, decanoic, dodecanoic, octodecanoic and eicosanoic acids, as well as olefinic acids such as oleic, linoleic, and linolenic acids, and linoleic dimer acid. A preferred carboxylic acid is 2-ethylhexanoic acid.

The metal salts may be prepared by merely blending a metal salt of a dithiophosphoric acid with a metal salt of a carboxylic acid in the desired ratio. The ratio of equivalents of dithiophosphoric acid to carboxylic acid is from about 0.5 up to about 400 to 1. The ratio may be from 0.5 up to about 200, or up to about 100, or up to about 50, or up to about 20 to 1. In one embodiment, the ratio is from 0.5 up to about 4.5 to 1, or from about 2.5 up to about 4.25 to 1. For this purpose, the equivalent weight of a dithiophosphoric acid is its molecular weight divided by the number of —PSSH groups therein, and the equivalent weight of a carboxylic acid is its molecular weight divided by the number of carboxy groups therein.

A second and preferred method for preparing the metal salts useful in this invention is to prepare a mixture of the acids in the desired ratio, such as those described above for the metal salts of the individual metal salts, and to react the acid mixture with one of the above described metal compounds. When this method of preparation is used, it is frequently possible to prepare a salt containing an excess of metal with respect to the number of equivalents of acid present; thus the metal salts may contain as many as 2 equivalents and especially up to about 1.5 equivalents of metal per equivalent of acid may be prepared. The equivalent of a metal for this purpose is its atomic weight divided by its valence. The temperature at which the metal salts are prepared is generally between about 30° C. and about 150° C., preferably up to about 125° C. U.S. Pat. Nos. 4,308,154 and 4,417,990 describe procedures for preparing these metal salts and disclose a number of examples of such metal salts. These patents are hereby incorporated by reference for those disclosures.

The phosphorus-containing antiwear or extreme pressure agent may also be a phosphite. In one embodiment, the phosphite is a di- or trihydrocarbyl phosphite. Preferably each hydrocarbyl group has from 1 to about 24 carbon atoms, more preferably from 1 to about 18 carbon atoms, and more preferably from about 2 to about 8 carbon atoms. Each hydrocarbyl group may be independently alkyl, alkenyl, or aryl. When the hydrocarbyl group is an aryl group, then it contains at least about 6 carbon atoms; preferably about 6 to about 18 carbon atoms. Examples of the alkyl or alkenyl groups include propyl, butyl, hexyl, heptyl, octyl, oleyl, linoleyl, stearyl, etc. Examples of aryl groups include phenyl, naphthyl, heptylphenol, etc. Preferably each hydrocarbyl group is independently propyl, butyl, pentyl, hexyl, heptyl, oleyl or phenyl, more preferably butyl, oleyl or phenyl and more preferably butyl or oleyl. Phosphites and their preparation are known and many phosphites are available commercially. Particularly useful phosphites are dibutylhydrogen phosphite, trioleyl phosphite and triphenyl phosphite.

In one embodiment, the phosphorus-containing antiwear or extreme pressure agent may be a phosphorus-containing amide. The phosphorus-containing amides may be prepared by the reaction of a phosphorus acid, preferably a dithiophosphoric acid, as described above, with an unsaturated amide. Examples of unsaturated amides include acrylamide, N,N'-methylene bisacrylamide, methacrylamide, crotonamide, and the like. The reaction product of the phosphorus acid with the unsaturated amide may be further reacted with linking or coupling compounds, such as formaldehyde or paraformaldehyde, to form coupled compounds. The phosphorus-containing amides are known in the art and are disclosed in U.S. Pat. Nos. 4,876,374, 4,770,807 and 4,670,169 which are incorporated by reference for their disclosures of phosphorus amides and their preparation.

In one embodiment, the phosphorus-containing antiwear or extreme pressure agent is a phosphorus-containing carboxylic ester. The phosphorus-containing carboxylic esters may be prepared by reaction of one of the above-described phosphorus acids, such as a dithiophosphoric acid, and an unsaturated carboxylic acid or ester, such as a vinyl or allyl acid or ester. If the carboxylic acid is used, the ester may then be formed by subsequent reaction with an alcohol. In one embodiment, the unsaturated carboxylic acids include the unsaturated fatty acids and esters described above.

The vinyl ester of a carboxylic acid may be represented by the formula $RCH{=}CH{-}O(O)CR^1$ (XIII), wherein R is a hydrogen or hydrocarbyl group having from 1 to about 30 carbon atoms, preferably hydrogen or a hydrocarbyl group having 1 to about 12, more preferably hydrogen, and $R^1$ is a hydrocarbyl group having 1 to about 30 carbon atoms, preferably 1 to about 12, more preferably 1 to about 8. Examples of vinyl esters include vinyl acetate, vinyl 2-ethylhexanoate, vinyl butanoate, and vinyl crotonate.

In one embodiment, the unsaturated carboxylic ester is an ester of an unsaturated carboxylic acid, such as maleic, fumaric, acrylic, methacrylic, itaconic, citraconic acids and the like. The ester can be represented by the formula $RO{-}(O)C{-}HC{=}CH{-}C(O)OR$ (XIV), wherein each R is independently a hydrocarbyl group having 1 to about 18 carbon atoms, preferably 1 to about 12, more preferably 1 to about 8 carbon atoms. Examples of unsaturated carboxylic esters, useful in the present invention, include methylacrylate, ethylacrylate, 2-ethylhexylacrylate, 2-hydroxyethylacrylate, ethylmethacrylate, 2-hydroxyethylmethacrylate, 2-hydroxypropylmethacrylate, 2-hydroxypropylacrylate, ethylmaleate, butylmaleate and 2-ethylhexylmaleate. The above list includes mono- as well as diesters of maleic, fumaric and citraconic acids.

In one embodiment, the phosphorus-containing antiwear agent is the reaction product of a phosphorus acid and a vinyl ether. The vinyl ether is represented by the formula $R{-}CH_2{=}CH{-}OR^1$ (XV), wherein R is hydrogen or a hydrocarbyl group having 1 to about 30, preferably 1 to about 24, more preferably 1 to about 12 carbon atoms, and $R^1$ is a hydrocarbyl group having 1 to about 30 carbon atoms, preferably 1 to about 24, more preferably 1 to about 12 carbon atoms. Examples of vinyl ethers include vinyl methylether, vinyl propylether, vinyl 2-ethylhexylether and the like.

Overbased Compositions (C)

The overbased compositions or salts are single phase, homogeneous, Newtonian systems characterized by a metal content in excess of that which would be present according to the stoichiometry of the metal and the particular organic compound reacted with the metal. The amount of excess metal is commonly expressed in terms of metal ratio. The term "metal ratio" is the ratio of the total equivalents of the metal to the equivalents of the acidic organic compound. A salt having 4.5 times as much metal as present in a normal salt will have metal excess of 3.5 equivalents, or a ratio of 4.5. These salts typically have a metal ratio of in excess of 1 and generally up to about 40 or more. In one embodiment, the metal ratio is from an excess of 1 up to about 40, preferably from about 1.5 up to about 35, or from about 2 up to about 30, more preferably from about 3 to about 26. In one embodiment the metal ratio is from about 1.5 to about 40, more preferably about 6 to about 35, more preferably about 10 to about 30, more preferably about 15 to about 30. In one embodiment, the metal ratio is from about 20 to about 30.

These overbased compositions, when used, are present in the inventive lubricating and functional fluid compositions at sufficient concentrations to provide the compositions with enhanced antiwear, extreme pressure or detergency properties. Generally, these overbased compositions are present in the inventive lubricants and functional fluids at concentrations up to about 20% by weight, and in one embodiment at concentrations up to about 10% by weight, and in one embodiment up to about 3% by weight. The overbased metal salt is generally present in an amount from about 0.5% to about 4%, or from about 0.7% to about 3%, or from about 0.9% to about 2% by weight.

The overbased compositions are prepared by reacting an acidic material, typically carbon dioxide, with a mixture comprising an acidic organic compound, a reaction medium comprising at least one inert, organic solvent for the acidic organic compound, a basic metal compound, typically a metal hydroxide or oxide, and a promoter. Generally, the basic metal compounds are oxides, hydroxides, chlorides, carbonates, and phosphorus acids (phosphonic or phosphoric acid) salts, and sulfur acid (sulfuric or sulfonic) salts. The metals of the basic metal compounds are generally alkali, alkaline earth, and transition metals. Examples of the metals of the basic metal compound include sodium, potassium, lithium, magnesium, calcium, barium, titanium, manganese, cobalt, nickel, copper, zinc, and preferably sodium, potassium, calcium, and magnesium. In one embodiment, the metal salts are prepared by reacting water with a mixture comprising an acidic organic compound, a reaction medium and a promoter. These metal salts and methods of making the same are described in U.S. Pat. No. 4,627,928. This disclosure is hereby incorporated by reference.

The acidic organic compounds are selected from the group consisting of carboxylic acids and anhydrides, sulfonic acids, phosphorus acids, phenols and derivatives thereof. Preferably, the overbased compositions are prepared from carboxylic acids or sulfonic acids. The carboxylic and sulfonic acids may have substituent groups derived from one or more of the above described olefins or polyalkenes. In one embodiment, $\overline{M}n$ varies from about 500 up to about 1500, preferably from about 700 up to about 1300, more preferably from about 800 up to about 1300. In another embodiment, the acidic organic compound is a sulfonic acid having a molecular weight less than about 1000, preferably from about 100 to about 800, more preferably from about 300 up to about 700.

Suitable carboxylic acids from which useful overbased metal salts can be prepared include aliphatic, cycloaliphatic and aromatic mono- and polybasic carboxylic acids free from acetylenic unsaturation, including naphthenic acids, alkyl- or alkenyl-substituted cyclopentanoic acids, and alkyl- or alkenyl-substituted cyclohexanoic acids, preferably alkenyl-substituted succinic acids or anhydrides. The aliphatic acids generally contain from about 8 to about 50, and preferably from about 12 to about 25 carbon atoms. The cycloaliphatic and aliphatic carboxylic acids are preferred, and they can be saturated or unsaturated. In one embodiment, the acidic organic compound is one or more of the above carboxylic acylating agents, such as the hydrocarbyl substituted carboxylic acylating agents.

Illustrative carboxylic acids include 2-ethylhexanoic acid, palmitic acid, stearic acid, myristic acid, oleic acid, linoleic acid, behenic acid, hexatriacontanoic acid, tetrapropylene-substituted glutaric acid, polybutenyl-substituted succinic acid derived from polybutene ($\overline{M}n$ from about 200 to about 1500, preferably from about 300 to about 1500, more preferably from about 800 to about 1200), polypropylenyl-substituted succinic acid derived from polypropene ($\overline{M}n$ from about 200 to about 2000, preferably from about 300 to about 1500, more preferably from about 800 to about 1200), acids formed by oxidation of petrolatum or of hydrocarbon waxes, commercially available mixtures of two or more carboxylic acids such as tall oil acid, and rosin acids, octadecyl-substituted adipic acid, chlorostearic acid, 9-methyl-stearic acid, dichlorostearic acid, stearyl-benzoic acid, eicosane-substituted naphthoic acid, dilauryl-decahydro-naphthalene carboxylic acid, and mixtures of these acids, their metal salts, and/or their anhydrides.

In another embodiment, the carboxylic acid is an alkyloxyalkylene-acetic acid or alkylphenoxy-acetic acid, more preferably alkylpolyoxyalkylene-acetic acid or salts thereof. Some specific examples of these compounds include: iso-stearyl-pentaethyleneglycol-acetic acid; iso-stearyl-O—$(CH_2CH_2O)_5CH_2CO_2Na$; lauryl-O—$(CH_2CH_2O)_{2.5}CH_2CO_2H$; lauryl-O—$(CH_2CH_2O)_{3.3}CH_2CO_2H$; oleyl-O$(CH_2CH_2O)_4$—$CH_2CO_2H$; lauryl-O—$(CH_2CH_2O)_{4.5}CH_2CO_2H$;lauryl-O$(CH_2CH_2O)_{10}CH_2CO_2H$; lauryl-O—$(CH_2CH_2O)_{16}CH_2CO_2H$; octyl-phenyl-O—$(CH_2CH_2O)_8CH_2CO_2H$; octyl-phenyl-O—$(CH_2CH_2O)_{19}CH_2CO_2H$; 2-octyldecanyl-O$(CH_2CH_2O)_6CH_2CO_2H$. These acids are available commercially from Sandoz Chemical under the tradename Sandopan acids.

In one embodiment, the carboxylic acids are aromatic carboxylic acids. A group of useful aromatic carboxylic acids are those of the formula (XVI)

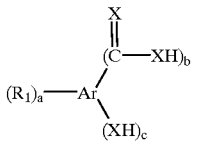

wherein $R_1$ is an aliphatic hydrocarbyl group preferably derived from the above-described polyalkenes, a is a number in the range of zero to about 4, usually 1 or 2, Ar is an aromatic group, each X is independently sulfur or oxygen, preferably oxygen, b is a number in the range of from 1 to about 4, usually 1 or 2, c is a number in the range of zero to about 4, usually 1 to 2, with the proviso that the sum of a, b and c does not exceed the number of valences of Ar. Examples of aromatic acids include substituted and non-substituted benzoic, phthalc, and salicylic acids.

The $R_1$ group in formula (XV!) is a hydrocarbyl group that is directly bonded to the aromatic group Ar. Examples of $R_1$ groups include substituents derived from the above olefins or polyalkenes. Examples of $R_1$ groups include those derived from polyethylenes, polypropylenes, polyisobutylenes, ethylene-propylene copolymers, chlorinated olefin polymers and oxidized ethylene-propylene copolymers.

The aromatic group as represented by "Ar", as well as elsewhere in other formulae in this specification and in the appended claims, may be mononuclear or polynuclear. Examples of mononuclear Ar moieties include benzene moieties, such as 1,2,4-benzenetriyl; 1,2,3-benezenetriyl; 3-methyl-1,2,4-benzenetriyl; 2-methyl-5-ethyl-1,3,4-benzenetriyl; 3-propoxy-1,2,4,5-benzenetetrayl; 3-chloro-1,2,4-benzenetriyl; 1,2,3,5-benzenetetrayl; 3-cyclohexyl-1,2,4-benzenetriyl; and 3-azocyclopentyl-1,2,5-benzenetriyl, and pyridine moieties, such as 3,4,5-azabenzene; and 6-methyl-3,4,5-azabenzene. The polynuclear groups may be those where an aromatic nucleus is fused at two points to another aromatic nucleus, such as naphthyl and anthracenyl groups. Specific examples of fused ring aromatic moieties Ar include: 1,4,8-naphthylene; 1,5,8-naphthylene; 3,6-dimethyl-4,5,8(1-azonaphthalene); 7-methyl-9-methoxy-1,2,5,9-anthracenetetrayl; 3,10-phenathrylene; and 9-methoxy-benz(a)phenanthrene-5,6,8,12-yl. The polynuclear group may those where at least two nuclei (either mononuclear or polynuclear) are linked through bridging linkages. These bridging linkages may be chosen from the group consisting of alkylene linkages, ether linkages, keto linkages, sulfide linkages, and polysulfide linkages of 2 to about 6 sulfur atoms. Specific examples of Ar when it is linked polynuclear aromatic moiety include: 3,3',4,4',5-bibenzenetetrayl; di(3,4-phenylene)ether; 2,3 -phenylene-2, 6-naphthylenemethane; and 3-methyl,9H-fluorene-1,2,4,5,8-yl; 2,2-di(3,4-phenylene)propane; sulfur-coupled 3-methyl-1,2,4-benzatriyl (having 1 to about 10 thiomethylphenylene groups); and amino-coupled 3-methyl-1,2,4-benzatriyl (having 1 to about 10 aminomethylphenylene groups). Typically Ar is a benzene nucleus, lower alkylene bridged benzene nucleus, or a naphthalene nucleus.

Within this group of aromatic acids, a useful class of carboxylic acids are those of the formula (XVII)

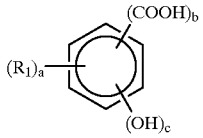

wherein $R_1$ is defined above in formula (XVI), a is a number in the range from zero to about 4, preferably from 1 to about 3; b is a number in the range from 1 to about 4, preferably from 1 to about 2, c is a number in the range from zero to about 4, preferably from 1 to about 2, and more preferably 1; with the proviso that the sum of a, b and c does not exceed 6. Preferably, b and c are each one and the carboxylic acid is a salicylic acid.

The salicylic acids preferably are aliphatic hydrocarbyl substituted salicylic acids. Overbased salts prepared from such salicylic acids wherein the aliphatic hydrocarbon substituents are derived from the above-described polyalkenes, particularly polymerized lower 1-mono-olefins such as polyethylene, polypropylene, polybutylene, ethylene/propylene copolymers and the like and having average carbon contents from about 50 to about 400 carbon atoms based on number average molecular weight are particularly useful.

The above aromatic carboxylic acids are well known or can be prepared according to procedures known in the art. Carboxylic acids of the type illustrated by these formulae and processes for preparing their neutral and basic metal salts are well known and disclosed, for example, in U.S. Pat. Nos. 2,197,832; 2,197,835; 2,252,662; 2,252,664; 2,714,092; 3,410,798; and 3,595,791.

The sulfonic acids may be aliphatic or aromatic sulfonic acids. In one embodiment, the sulfonic acids ar mono-, di-, and tri-hydrocarbyl substituted aromatic sulfonic acids, preferably an aliphatic substituted aromatic sulfonic acid. The hydrocarbyl substituent may be derived from any of the above-described olefins or polyalkenes, or oligomers of the above described olefins. Examples of sulfonic acids include mahogany sulfonic acids, bright stock sulfonic acids, petroleum sulfonic acids, mono- and polywax-substituted naphthalene sulfonic acids, cetylchlorobenzene sulfonic acids, cetylphenol sulfonic acids, cetylphenol disulfide sulfonic acids, cetoxycapryl benzene sulfonic acids, dicetyl thianthrene sulfonic acids, dilauryl beta-naphthol sulfonic acids, dicapryl nitronaphthalene sulfonic acids, saturated paraffin wax sulfonic acids, unsaturated paraffin wax sulfonic acids, hydroxy-substituted paraffin wax sulfonic acids, tetraisobutylene sulfonic acids, tetra-amylene sulfonic acids, chloro-substituted paraffin wax sulfonic acids, nitroso-substituted paraffin wax sulfonic acids, cetylcyclopentyl sulfonic acids, lauryl cyclohexyl sulfonic acids, mono- and polywax-substituted cyclohexyl sulfonic acids, dodecylbenzene sulfonic acids, didodecylbenzene sulfonic acids, dinonylbenzene sulfonic acids, cetylchlorobenzene sulfonic acids, dilauryl beta-naphthalene sulfonic acids, the sulfonic acid derived by the treatment of at least one of the above-described polyalkenes (preferably polybutene) with chlorosulfonic acid, nitronaphthalene sulfonic acid, paraffin wax sulfonic acid, cetyl-cyclopentane sulfonic acid, lauryl-cyclohexane sulfonic acids, polyethylenyl substituted sulfonic acids derived from polyethylene ($\overline{M}n$ from about 300 to about 1500, preferably from about 700 to about 1500, more preferably from about 800 to about 1200) sulfonic acids, etc., "dimer alkylate" sulfonic acids, and the like.

Alkyl-substituted benzene sulfonic acids wherein the alkyl group contains at least 8 carbon atoms, including dodecyl benzene "bottoms" sulfonic acids, are particularly useful. The latter are acids, derived from benzene, which has been alkylated with propylene tetramers or isobutene trimers to introduce 1, 2, 3, or more branched-chain $C_{12}$ substituents on the benzene ring. Dodecyl benzene bottoms, principally mixtures of mono- and di-dodecyl benzenes, are available as by-products from the manufacture of household detergents. Similar products obtained from alkylation bottoms formed during manufacture of linear alkyl sulfonates (LAS) are also useful in making the Sulfonates used in this invention.

A group of useful sulfonic acids are mono-, di-, and tri-alkylated benzene and naphthalene (including hydrogenated forms thereof) sulfonic acids. Illustrative of the synthetically produced alkylated benzene and naphthalene sulfonic acids are those containing alkyl substituents having from about 8 to about 30 carbon atoms, preferably from about 12 to about 30 carbon atoms, and advantageously about 24 carbon atoms. Such acids include di-isododecylbenzene sulfonic acid, wax-substituted phenol sulfonic acid, wax-substituted benzene sulfonic acids, polybutenyl-substituted sulfonic acid, polypropylene-substituted sulfonic acids derived from polypropylene having a number average molecular weights ($\overline{M}n$) from about 300–1500, more preferably from about 800–1200, cetylchlorobenzene sulfonic acid, di-cetylnaphthalene sulfonic acid, di-lauryldiphenylether sulfonic acid, diisononylbenzene sulfonic acid, di-isooctadecyl-benzene sulfonic acid, stearylnaphthalene sulfonic acid, and the like.

The production of sulfonic acids from detergent manufacture by-products by reaction with, e.g., $SO_3$, is well known to those skilled in the art. See, for example, the article "Sulfonates" in Kirk-Othmer "Encyclopedia of Chemical Technology", Second Edition, Vol. 19, pp. 291 et seq. published by John Wiley & Sons, N.Y. (1969).

The phosphorus containing acids useful in making these overbased salts include any of the above phosphorus acids. In one embodiment, the phosphorus containing acid is the reaction product of one or more of above polyalkenes and phosphorus sulfides.

The reaction of the polyalkene and the phosphorus sulfide generally may occur by simply mixing the two at a temperature above 80° C., preferably between 100° C. and 300° C. Generally, the products have a phosphorus content from about 0.05% to about 10%, preferably from about 0.1% to about 5%. The relative proportions of the phosphorizing agent to the olefin polymer is generally from 0.1 part to 50 parts of the phosphorizing agent per 100 parts of the olefin polymer. The phosphorus-containing acids useful in the present invention are described in U.S. Pat. No. 3,232,883, issued to LeSuer. This reference is herein incorporated by reference for its disclosure to the phosphorus-containing acids and methods for preparing the same.

The phenols useful in making the overbased salts of the invention can be represented by the formula $(R_1)_a$—Ar—$(OH)_b$ (XVII), wherein $R_1$ is defined above in formula (XV); Ar is an aromatic group as defined above in formula (XV); a and b are independently numbers of at least one, the sum of a and b being in the range of two up to the number of displaceable hydrogens on the aromatic nuclei or nuclee of Ar. Preferably, a and b are independently numbers in the range from 1 to about 4, more preferably from 1 to about 2. $R_1$ and a are preferably such that there is an average of at least about 8 aliphatic carbon atoms provided by the $R_1$ groups for each phenol compound.

The number of aromatic nuclei, fused, linked or both, in Ar can play a role in determining the integer values of a and b. For example, when Ar contains a single aromatic nucleus, the sum of a and b is from 2 to 6. When Ar contains two aromatic nuclei, the sum of a and b is from 2 to 10. With a tri-nuclear Ar moiety, the sum of a and b is from 2 to 15. The value for the sum of a and b is limited by the fact that it cannot exceed the total number of displaceable hydrogens on the aromatic nucleus or nuclei of Ar.

The promoters, that is, the materials which facilitate the incorporation of the excess metal into the overbased material, are also quite diverse and well known in the art. A particularly comprehensive discussion of suitable promoters is found in U.S. Pat. Nos. 2,777,874; 2,695,910; 2,616,904; 3,384,586; and 3,492,231. These patents are incorporated by reference for their disclosure of promoters. In one embodiment, promoters include the alcoholic and phenolic promoters. The alcoholic promoters include the alcohols having from one to about 12 carbon atoms, such as methanol, ethanol, amyl alcohol, octanol, isopropanol, and mixtures of these and the like. Phenolic promoters include a variety of hydroxy-substituted benzenes and naphthalenes. A particularly useful class of phenols are the alkylated phenols of the type listed in U.S. Pat. No. 2,777,874, e.g., heptylphenols, octylphenols, and nonylphenols. Mixtures of various promoters are sometimes used.

Acidic materials, which are reacted with the mixture of acidic organic compound, promoter, metal compound and reactive medium, are also disclosed in the above cited patents, for example, U.S. Pat. No. 2,616,904. Included within the known group of useful acidic materials are liquid acids, such as formic acid, acetic acid, nitic acid, boric acid, sulfuric acid, hydrochloric acid, hydrobromic acid, carbamic acid, substituted carbamic acids, etc. Acetic acid is a very useful acidic material although inorganic acidic compounds, such as HCl, $SO_2SO_3$,$CO_2$, $H_2S$, $N_2O_3$, etc., are ordinarily employed as the acidic materials. Preferred acidic materials are carbon dioxide and acetic acid, more preferably carbon dioxide.

Methods for preparing the overbased compositions as well as an extremely diverse group of overbased compositions are disclosed in the following U.S. Pat. No. Nos. 2,616,904; 2,616,905; 2,616,906; 3,242,080; 3,250,710; 3,256,186; 3,274,135; 3,492,231; and 4,230,586. The disclosures in these patents relating to overbasing procedures, materials which can be overbased, metal bases, promoters, and acidic materials are incorporated herein by reference.

Other descriptions of basic sulfonate salts which can be incorporated into the lubricating and functional fluid compositions of this invention and techniques for making them can be found in the following U.S. Pat. Nos.: 2,174,110; 2,202,781; 2,239,974; 2,319,121; 2,337,552; 3,488,284; 3,595,790; and 3,798,012. These are hereby incorporated by reference for their disclosures in this regard.

The temperature at which the acidic material is contacted with the remainder of the reaction mass depends to a large measure upon the promoting agent used. With a phenolic promoter, the temperature usually ranges from about 80° C. to about 300° C., preferably from about 100° C. to about 200° C. When an alcohol or mercaptan is used as the promoting agent, the temperature usually will not exceed the reflux temperature of the reaction mixture.

In one embodiment, the overbased compositions are borated overbased metal salts. Borated overbased metal salt are prepared by reacting a boron compound with a overbased metal salt, such as a carbonated overbased metal salt, or by using boric acid to overbase the organic acid. Boron compounds include boron oxide, boron oxide hydrate, boron trioxide, boron trifluoride, boron tribromide, boron trichloride, boron acid such as boronic acid, boric acid, tetraboric acid and metaboric acid, boron hydrides, boron amides and various esters of boron acids. The boron esters are preferably lower alkyl (1–7 carbon atoms) esters of boric acid. Preferably, the boron compound is boric acid. Generally, the overbased metal salt is reacted with a boron compound at about 50° C. to about 250° C., preferably 100° C. to about 200° C. The reaction may be accomplished in the presence of a solvent, such as mineral oil, naphtha, kerosene, toluene or xylene. The borated overbased metal salts generally contains from about 0.1% up to about 15%, or from about 0.5% up to about 10%, or from about 1% up to about 8% by weight of the boron. Porated overbased compositions, lubricating compositions containing the same and methods of preparing borated overbased compositions are found in U.S. Pat. No. 4,744,920, issued to Fischer et al; U.S. Pat. No. 4,792,410, issued to Schwind et al; and PCT Publication WO88/03144. The disclosures relating to the above are hereby incorporated by reference.

The following examples relate to overbased compositions and borated overbased compositions.

EXAMPLE O-1

(a) A mixture of 853 grams of methyl alcohol, 410 grams of blend oil, 54 grams of sodium hydroxide, and a neutralizing amount of additional sodium hydroxide is prepaed, The amount of the latter addition of sodium hydroxide is dependent upon the acid number of the subsequently added sulfonic acid. The temperature of the mixture is adjusted to 49° C. A mixture (1070 grams) of straight chain dialkyl benzene sulfonic acid (molecular weight=430) and blend oil (42% by weight active content) is added while maintaining the temperature at 49–57° C. Polyisobutenyl (number average $\overline{M}n$=950)-substituted succinic anhydride (145 grams) is added to the reaction mixture. Sodium hydroxide (939 grams) is added to the reaaction mixture and the temperature is adjusted to 71° C. The reaction mixture is blown with 460 grams of carbon dioxide. The mixture is flash stripped to 149° C., and filtered to clarity to provide the desired product. The product is an overbased sodium sulfonate having a base number (bromophenol blue) of 440, a metal content of 19.45% by weight, a metal ratio of 20, a sulfate ash content of 58% by weight, and a sulfur content of 1.35% by weight.

(b) A mixture of 1000 grams of the product from Example O-1(a) above, 0.13 gram of an antifoaming agent kerosene solution of Dow Corning 200 Fluid having a viscosity of 1000 cSt at 25° C.), and 133 grams of blend oil is heated to 74–79° C. with string. Boric acid (486 grams) is added to the reaction mixture. The reaction mixture is heated to 121° C. to liberate water of reaction and 40–50% by weight of the $CO_2$ contained in the product from Example O-1(a). The reaction mixture is heated to 154–160° C. and maintained at that temperature until the free and total water contents are reduced to 0.3% by weight or less and approximately 1–2% by weight, respectively, The reaction product is cooled to room temperature and filtered. The filtrate has 6.1% boron, 14.4% sodium, and 35% 100 neutral mineral oil.

EXAMPLE O-2

(a) A mixture of 1000 grams of a primarily branched chain monoalkyl benzene sulfonic acid ($\overline{M}w$=500), 771 grams of o-xylene, and 75.2 grams of polyisobutenyl (number average $\overline{Mn}$=950) succinic anhydride is prepared and the temperature is adjusted to 46° C. Magnesium oxide (87.3 grams), acetic acid (35.8 grams), methyl alcohol (31.4 grams), and water (59 grams) are added sequentially to the reaction vessel. The reaction mixture is blown with 77.3 grams of carbon dioxide at a temperature of 49–54° C. Additionally, 87.3 grams of magnesium oxide, 31.4 grams of methyl alcohol and 59 grams of water are added to the reaction vessel, and the reaction mixture is blown with 77.3 grams of carbon dioxide at 49–54° C. The foregoing steps of magnesium oxide, methyl alcohol and water addition, followed by carbon dioxide blowing are repeated once. O-xylene, methyl alcohol and water are removed from the reaction mixture using atmospheric and vacuum flash stripping. The reaction mixture is cooled and filtered to clarity. The product is an overbased magnesium sulfonate having a base number (bromophenol blue) of 400, a metal content of 9.3% by weight, a metal ratio of 14.7, a sulfate ash content of 46.0%, and a sulfur content of 1.6% by weight.

(b) A mixture of 1000 grams of the product from Example O-2(a) and 181 grams of diluent oil is heated to 79° C. Boric acid (300 grams) is added and the reaction mixture is heated to 124° C. over a period of 9 hours. The reaction mixture is maintained at 121–127° C. for 2–3 hours. A nitrogen sparge is started and the reaction mixture is heated to 149° C. to remove water until the water content is 3% by weight or less. The reaction mixture is filtered to provide the desired product. The product contains 7.63% magnesium and 4.35% boron.

EXAMPLE O-3

(a) A reaction vessel is charged with 281 parts (0.5 equivalent) of a polybutenyl-substituted succinic anhydride derived from a polybutene ($\overline{Mn}$=1000), 281 parts of xylene, 26 parts of tetrapropenyl substituted phenol and 250 parts of 100 neutral mineral oil. The mixture is heated to 80° C. and 272 parts (3.4 equivalents) of an aqueous sodium hydroxide solution are added to the reaction mixture. The mixture is blown with nitrogen at 1 SCFH and the reaction temperature is increased to 148° C. The reaction mixture is then blown with carbon dioxide at 1 SCFH for one hour and 25 minutes while 150 parts of water is collected. The reaction mixture is cooled to 80° C. where 272 parts (3.4 equivalents) of the above sodium hydroxide solution is added to the reaction mixture and the mixture is blown with nitrogen at 1 SCFH. The reaction temperature is increased to 140° C. where the reaction mixture is blown with carbon dioxide at 1 SCFH for 1 hour and 25 minutes while 150 parts of water is collected. The reaction temperature is decreased to 100° C. and 272 parts (3.4 equivalents) of the above sodium hydroxide solution is added while blowing the mixture with nitrogen at 1 SCFH. The reaction temperature is increased to 148° C. and the reaction mixture is blown with carbon dioxide at 1 SCFH for 1 hour and 40 minutes while 160 parts of water is collected. The reaction mixture is cooled to 90° C. and where 250 parts of 100 neutral mineral oil are added to the reaction mixture. The reaction mixture is vacuum stripped at 70° C. and the residue is filtered through diatomaceous earth. The filtrate contains 50.0% sodium sulfate ash (theoretical 53.8%) by ASTM D-874, total base number of 408, a specific gravity of 1.18 and 37.1% oil.

(b) A reaction vessel is charged with 700 parts of the product of Example O-3(a). The reaction mixture is heated to 75° C. where 340 parts (5.5 equivalents) of boric acid is added over 30 minutes. The reaction mixture is heated to 110° C. over 45 minutes and the reaction temperature is maintained for 2 hours. A 100 neutral mineral oil (80 parts) is added to the reaction mixture. The reaction mixture is blown with nitrogen at 1 SCFH at 160° C. for 30 minutes while 95 pats of water is collected. Xylene (200 parts) is added to the reaction mixture and the reaction temperature is maintained at 130–140° C. for 3 hours. The reaction mixture is vacuum stripped at 150° C. and 20 millimeters of mercury. The residue is filtered through diatomaceous earth. The filtrate contains 5.84% boron (theoretical 6.43) and 33.1% oil. The residue has a total base number of 309.

EXAMPLE O-4

A mixture of 794.5 kg of polyisobutenyl (Mn=950) succinic anhydride, 994.3 kg of SC-100 Solvent (a product of Ohio Solvents identified as an aromatic hydrocarbon solvent), 858.1 kg of blend oil, 72.6 kg of propylene tetramer phenol, 154.4 kg of water, 113.5 grams of a kerosene solution of Dow Corning 200 having a viscosity 1000 cSt at 25° C., and 454 grams of caustic soda flake is prepared at room temperature. The reaction mixture is heated exothermically by 10° C. The reaction mixture is heated with stirring under reflux conditions to 137.8° C. over a period of 1.5 hours. The reaction mixture is blown with $CO_2$ at a rate of 45.4 kg per hour for 5.9 hours. Aqueous distillate (146.2 kg) is removed from the reaction mixture. The reaction mixture is cooled to 82.2° C., where 429 kg of organic distillate are added back to the reaction mixture. The reaction mixture is heated to 138° C. and 454 kg of caustic soda are added. The reaction mixture is blown with $CO_2$ at a rate of 45.4 kg per hour for 5.9 hours while maintaining the temperature at 135–141° C. The reaction mixture is heated to 149° C. and maintained at that temperature until distillation ceases. 149.4 kg of aqueous distillate and 487.6 kg of organic distillate are removed over a 5-hour period. The reaction mixture is flash stripped to 160° C. at a pressure of 70 mm Hg absolute. 32.7 kg of aqueous distillate and 500.3 kg of organic distillate are removed from the reaction mixture. 858.1 kg of blend oil are added. 68.1 kg of diatomaceous earth filter aid are added to the reaction mixture. The reaction mixture is filtered to provide the desired product. The resulting product has a sulfate ash content of 38.997% by weight, a sodium content of 12.63% by weight, a $CO_2$ content of 12.0% by weight, a base number (bromophenol blue) of 320, a viscosity of 94.8 cSt at 100° C., and a specific gravity of 1.06.

In one embodiment, the overbased metal salt is a sulfite or sulfate overbased metal salt. As used in the specification and appended claims, a sulfite overbased metal salt contains a salt which is composed of a metal cation and a $SO_x$ anion, where x is a number from 2 to about 4. The salts may be sulfite, sulfate or mixtures of sulfite and sulfate salts. The sulfite or sulfate overbased metal salts may be prepared from the above described overbased metal salts or the borated overbased metal salts. In this embodiment, the sulfite or sulfate overbased metal salts may be prepared by using the above described sulfurous acid, sulfurous ester, or sulfurous anhydride as the acidic material in the overbasing process described above. The overbased metal salts also may be prepared by using an acidic material other than a sulfurous acid, sulfurous ester, or sulfurous anhydride. When the overbased salt is prepared with acidic materials other than sulfurous acid, anhydride or esters, then the overbased salt is treated with a sulfurous acid, sulfurous anhydride, sulfurous ester, or a source thereof. This treatment displaces the acidic material with the sulfurous acid, sulfurous anhydride, or sulfurous ester. Generally an excess of sulfurous acid, ester, or anhydride is used to treat the overbased metal salts.

Typically, from about 0.5 to about 1 equivalent of sulfurous acid, ester, or anhydride is reacted with each equivalent of overbased metal salts. Contacting a carbonated overbased or a borated carbonated overbased metal salt with a sulfurous acid or anhydride is preferred. The contacting is accomplished by techniques known to those in the art.

In one embodiment, the carbonated overbased metal salts are treated with sulfur dioxide ($SO_2$). Generally an excess of sulfur dioxide is used. The contacting of the metal salt is continued until a desired amount of the acidic material is displaced by the sulfurous acid, anhydride, or ester, e.g. $SO_2$. Generally, it is preferred to effect a complete or substantially complete displacement of the acidic material. The displacement of acidic material may conveniently be followed by infrared spectral, sulfur, or total base number analysis. When the acidic maternal is carbon dioxide, the decrease in the carbonate peak (885 $cm^{-1}$) shows the displacement of the carbon dioxide. The sulfite peak appears as a broad peak at 971 $cm^{-1}$. The sulfate peak occur as a broad peak at 1111 $cm^{-1}$. The temperature of the reaction can be from about room temperature up to the decomposition temperature of the reactants or desired product. Generally, the temperature is in the range of about 70° C. up to about 250° C., preferably from about 100° C. to about 200° C.

In one embodiment, a sulfite overbased metal salt is further reacted with an oxidizing agent to form a sulfate overbased metal salt. The oxidizing materials include oxygen and peroxides, such as hydrogen peroxides and organic peroxides (e.g. $C_{1-8}$ peroxides). In another embodiment, the sulfite or sulfate overbased metal salt is prepared by reacting one or more of the above overbased metal salts, including the borated overbased metal salts with sulfuric acid.

The following Examples O-5 to O-10 are provided to illustrate procedures for displacing acidic material from the overbased product with $SO_2$ or a source of $SO_2$.

EXAMPLE O-5

The product of Example O-1(a) (1610 grams, 12.6 equivalents) is blown with 403 grams (12.6 equivalents) of $SO_2$ over an eight hour period at a temperature of 135–155° C. and a flow rate of 0.52 cfh. The $CO_2$ level in the resulting product is 1.47% by weight. The total base number (bromophenol blue) is 218. The sulfur content is 12.1% by weight and the sodium content is 17.6% by weight.

EXAMPLE O-6

The product of Example O-1(a) (3000 grams, 23.5 equivalents) is blown with 376 grams (11.75 equivalents) of $SO_2$ at a temperature of 140–150° C. and a flow rate of 1.4 cfh for eight hours. The resulting product is stored at room temperature for 16 hours under a nitrogen blanket and then filtered using diatomaceous earth. The product has a sulfur content of 8.2% by weight and a sodium content of 18.2% by weight.

EXAMPLE O-7

The product of Example O-6 (1750 grams, 10.0 equivalents) is blown with 320 grams (10.0 equivalents) of $SO_2$ at a temperature of 130° C. and a flow rate of 1.0 cfh for 15.5 hours. The resulting product is filtered using diatomaceous earth. The product has a sulfur content of 7.26% by weight, a sodium content of 12.6% by weight, and a boron content of 6.06% by weight.

EXAMPLE O-8

The product of Example O-5 (3480 grams, 20 equivalents) is blown with 640 grams (20 equivalents) of $SO_2$ over an 15 hour period at a temperature of 140° C. and a flow rate of 1.35 cfh. The reaction mixture is then blown with nitrogen for 0.5 hour. The mixture is filtered using diatomaceous earth to provide 3570 grams of the desired product. The sulfur content is 8.52% by weight and the sodium content is 13.25% by weight.

EXAMPLE O-9

The product of Example O-1a (1100 grams, 4.4 equivalents, based on equivalents of sulfite) is charged to a reaction vessel and air blown for eight hours at 150° C. The vessel contents are cooled to 100° C. where 250 grams (2.2 equivalents) of a 30% solution of hydrogen peroxide is added dropwise over 1.5 hours. Distillate is removed and the mixture is heated to 135° C. Reaction is cooled to 120° C. where 250 grams (2.2 equivalents) of the above hydrogen peroxide solution is added to the mixture. The reaction temperature increases exothermically to 130° C. Infrared analysis indicates sulfate peaks (1111 $cm^{-1}$), and a decrease in sulfite peak (971 $cm^{-1}$). More hydrogen peroxide solution (25 grams, 0.2 equivalent) is added to the reaction vessel and the temperature is increased from 125° C. to 130° C. over two hours. The reaction mixture is blown with nitrogen at 157° C. to remove volatile materials. The residue is centrifuged (1600 RPM). Liquid is decanted and stripped at 155° C. with nitrogen blowing. The residue is the product. The product has 12.4% sulfur, 52.2% sulfated ash, a base number (phenolphthalein) of 11, and a base number (bromophenol blue) of 60.

EXAMPLE O-10

A reaction vessel is charged with 3700 grams (14.8 equivalents, based on sulfite) of the product of Example O-1a. The vessel contents are heated to 110° C. where 256 grams (2.3 equivalents) of a 30% hydrogen peroxide solution is added to the reaction vessel. Distillate is collected. An additional 1505 grams (13.28 equivalents) of 30% hydrogen peroxide solution is added to the reaction vessel over two hours. Water is removed by nitrogen blowing and the reaction temperature increases from 110° C. to 157° C. over two hours. The product is diluted with toluene and filtered through diatomaceous earth. The filtrate is transferred to a stripping vessel and blown with nitrogen at 1.5 standard cubic feet per hour at 150° C. The residue is the desired product. The product has 16.3% sodium, 11.9% sulfur, a base number (phenolphthalein) of 5.8, and a base number (bromophenol blue) of 39.

In one embodiment, the overbased metal salt is a sulfurized overbased composition. The acidic material used in the preparation of the overbased metal salt is $SO_2$ or a source of $SO_2$. The overbased metal salt is further reacted using the sulfur or sulfur source. The sulfur sources include elemental sulfur and any of the sulfur compounds described herein. In another embodiment, the acidic material is other than $SO_2$ or a source of $SO_2$ (that is, the acidic material is $CO_2$, carbamic acid, acetic acid, formic acid, boric acid, trinitromethane, etc.), and in this embodiment the overbased metal salt is contacted with an effective amount of $SO_2$ or a source of $SO_2$ for an period of time to displace at least part of the acidic material from the overbased metal salt prior to or during sulfurization with the sulfur or sulfur source.

The contacting of the overbased metal salt with the $SO_2$ or source of $SO_2$ is preferably effected using standard gas/liquid contacting techniques (e.g., blowing, sparging, etc.). In one embodiment, $SO_2$ flow rates from about 0.1 to about 100 cfh, preferably from about 0.1 to about 20 cfh, more preferably from about 0.1 to about 10 cfh, more preferably from about 0.1 to about 5 cfh, can be used. Contacting of the overbased metal salt with the $SO_2$ or source of $SO_2$ is continued until a desired amount of the acidic material has been displaced by the $SO_2$ or source of $SO_2$. Generally, it is preferred to effect a complete or substantially complete displacement of the acidic material with the $SO_2$ or source of $SO_2$. However the weight ratio of nondisplaced acidic material to displaced acidic material can range up to about 20:1, and in some instances can be from about 20:1 to about 1:20, and often from about 1:1 to about 1:20. Techniques known to those skilled in the art such as infrared spectral analysis, base number measurement, etc., can be used to determine the progress of the reaction and the desired end point. The sources of $SO_2$ include the oxo acids of sulfur. These include sulfurous acid, thiosulfuric acid and dithionous acid. The temperature of the reaction can be from room temperature up to the decomposition temperature of the reactants or the reaction products, and is preferably in the range from about 70° C. to about 250° C., with the ranges from about 100° C. to about 200° C. and from about 120° C. to about 170° C. being useful. The time of the reaction is dependent upon the desired extent of displacement. The reaction can be conducted over a period of about 0.1 to about 50 hours, and often is conducted over a period of about 3 to about 18 hours.

As indicated above, displacement of the acidic material with the $SO_2$ or source of $SO_2$ can be effected prior to or during the sulfurization of the overbased metal salt with the sulfur or sulfur source. When displacement of the acidic material with the $SO_2$ or source of $SO_2$ is effected simultaneously with the sulfurization of the overbased product with the sulfur or sulfur source, unexpected rapid rates of formation of desired thiosulfate products have been observed.

The sulfurized overbased compositions are made by contacting the overbased metal salt with the sulfur or sulfur source for an effective period of time and at a sufficient temperature to form the desired sulfurized product. As indicated above, it is believed that the sulfurized product is at least in part a thiogulfate. The contacting can be effective by mixing the sulfur or sulfur source with the overbased product using standard mixing or blending techniques. The contact time is typically from about 0.1 to about 200 hours, preferably about 1 to about 100 hours, more preferably about 5 to about 50 hours, and in many instances from about 10 to about 30 hours. The temperature is generally from about room temperature up to the decomposition temperature of the reactants or desired products having the lowest such temperature, preferably from about 20° C. to about 300° C., more preferably about 20° C. to about 200° C., more preferably about 20° C. to about 150° C. Typically, the ratio of equivalents of sulfur or sulfur source per equivalent of overbased product is from about 0.1 to about 10, preferably about 0.3 to about 5, more preferably about 0.5 to about 1.5. In one embodiment the ratio is about 0.65 to about 1.2 equivalents of sulfur or sulfur Source per equivalent of overbased product.

For purposes of this reaction, an equivalent of the sulfur or sulfur source is based upon the number of moles of sulfur available to react with the $SO_2$ in the overbased metal salt. Thus, for example, elemental sulfur has an equivalent weight equal to its atomic weight. An equivalent of the overbased metal salt is based upon the number of moles of $SO_2$ in the overbased metal salt available to react with the sulfur. Thus, an overbased metal salt containing one mole of $SO_2$ has an equivalent weight equal to its actual weight. An overbased metal salt containing two moles of $SO_2$ has an equivalent weight equal to one half its actual weight.

While not wishing to be bound by theory, it is believed that the product that is formed using $SO_2$ or a source of $SO_2$ as the acidic material or is formed using $SO_2$ or a source of $SO_2$ to displace the acidic material is a mixture of a number of products but includes, at least in part, a sulfite, and the product that is formed as a result of the sulfurization with the sulfur or sulfur source is also a mixture of a number of products but includes at least in part, a thiosulfate. Thus, for example, if the overbased metal salt is a sodium sulfonate made using $CO_2$ as the acidic material, it can be represented by the formula, $RSO_3Na(Na_2CO_3)_x$ (Overbased Sodium Sulfonate), the sulfite formed by contacting this sodium sulfonate with the $SO_2$ or source of $SO_2$ can be represented by the formula, $RSO_3Na(Na_2SO_3)_x$ (Sulfite), and the thiosulfate formed by the sulfurization of this sulfite with the sulfur or sulfur source can be represented by the formula $RSO_3Na(Na_2S_2O_3)_x$ (thiosulfate), wherein in each formula x is a number that is generally one or higher. The progress of both of these reactions can be measured using infrared or base number analysis. One technique for quantitatively measuring the sulfite and thiosulfate content of the inventive sulfurized overbased products is through the use of differential pulse polarography which is a known analytical technique involving measuring current vs. potential applied to a sample within an electrolytic cell.

The following Examples O-11 through O-16 are illustrative of the preparation of the sulfurized overbased products.

EXAMPLE O-11

A mixture of 1400 grams (5.5 equivalents) of a first sulfite derived from the product of Example O-1(a) and $SO_2$ having a sulfur content of 12.6% by weight and a sodium content of 17.6% by weight, 300 grams (1.0 equivalent) of a second sulfite derived from the product of Example O-1(a) and $SO_2$ having a sulfur content 10.7% by weight and a sodium content of 16.2% by weight, and 208 grams (6.5 equivalents) of sulfur are heated to a temperature of 140° C. and maintained at that temperature with stirring for 22 hours to provide 1535 grams of the desired product which is in the form of a brown oil. The product has a sulfur content of 22% by weight and a sodium content of 16.9% by weight.

EXAMPLE O-12

A mixture of 1172 grams (4 equivalents) of the product from Example O-5 and 64 grams (2 equivalents) of sulfur are heated to a temperature of 140–150° C. and maintained at that temperature with stirring for 21 hours to provide 1121 grams of the desired product which is in the form of a brown oil. The product has a sulfur content of 15.7% by weight and a sodium content of 17.2% by weight.

EXAMPLE O-13

A mixture of 880 grams (2 equivalents) of the product from Example O-9 and 77 grams (2.4 equivalents) of sulfur are heated to a temperature of 130° C. and maintained at that temperature with stirring for 17.5 hour. 100 grams of diluent oil are added. The reaction mixture is heated to 140–150° C. with stirring for one hour. The mixture is filtered to provide 985 grams of the desired product which is in the form of a brown oil. The product has a sulfur content of 12.1% by weight, a sodium content of 10.48% by weight, and a boron content of 5.0% by weight.

EXAMPLE O-14

A mixture of 1310 grams (3.36 equivalents) of the product from Example O-8 and 53.4 grams (1.67 equivalents) of sulfur are heated to a temperature of 140–150° C. and maintained at that temperature with stirring for 29.5 hours. The reaction mixture is cooled to 100° C. and filtered using diatomaceous earth to provide 1182 grams of the desired product which is in the form of a brown-black oil. The product has a sulfur content of 12.0% by weight and a sodium content of 17.5% by weight, and a base number (bromophenol blue) of 241. The product has copper strip ratings (ASTM D-130) of 1B–2A (100° C., 3 hours, 1%) and 2A–2B (100° C., 3 hours, 5%).

EXAMPLE O-15

A mixture of 8960 grams (70 equivalents) of the product from Example O-1(a) and 1024 grams (32 equivalents) of sulfur is heated to 140–150° C. with stirring. 2240 grams (70 equivalents) of $SO_2$ are blown through the mixture at a rate of 1.5 cfh over a period of 34 hours. The reaction mixture is blown with nitrogen for one hour at 150° C. and filtered using diatomaceous earth to provide 9330 grams of the desired product which is in the form of a clear brown oil and has a sulfur content of 21.68% by weight, a sodium content of 15.86% by weight and a copper strip rating (ASTM D-130) of 1A (100° C., 3 hours, 5%).

In one embodiment the inventive sulfurized overbased products are contacted with an effective amount of at least one active sulfur reducing agent to reduce the active sulfur content of such products. This can be done in instances wherein the sulfurized overbased products are considered to be too corrosive for the desired application. The term "active sulfur" is used herein to mean sulfur in a form that can cause staining of copper and similar materials. Standard tests such as ASTM D-130 are available for measuring sulfur activity.

The active sulfur reducing agent can be air in combination with activated carbon, steam, one or more of the boron compounds (e.g., boric acid) described above , one or more of the phosphites (e.g., di and tributylphosphite, triphenyl phosphite) described above, or one or more of the olefins (e.g., $C_{1618}$ α-olefin mixture) described above. In one embodiment, the active sulfur reducing agent is the reaction product of one or more of the above acylated amine or a Group II metal dithiophosphate Typically, the weight ratio of the active sulfur reducing agent to the sulfurized overbased product can be up to about 1, but is preferably up to about 0.5. In one embodiment, the active sulfur reducing agent is boric acid and the weight ratio between it and the sulfurized overbased product is from about 0.001 to about 0.1, preferably about 0.005 to about 0.03. In one embodiment, the active sulfur reducing agent is one of the above indicated phosphites, preferably triphenyl phosphite, and the weight ratio of it to the sulfurized overbased product of from about 0.01 to about 0.2. In one embodiment, the active sulfur reducing agent is one of the above discussed olefins and the weight ratio of it to the sulfurized overbased product is from about 0.2 to about 0.7.

Dispersants (D)

As described above, the lubricants and/or functional fluids may contain a dispersant. The dispersants include acylated amines, carboxylic esters, Mannich reaction products, hydrocarbyl substituted amines, and mixtures thereof. In one embodiment, the dispersant contains boron. The dispersant is generally present in an amount from about 0.1% up to about 10%, or from about 0.5% up to about 8% by weight. In one embodiment, such as in a crankcase lubricant, the dispersant is present in an amount from about 1% up to 10%, preferably from about 2% up to about 8%, or from about 2.5% up to about 6% by weight. In another embodiment, such as in a gear oil, the dispersant is present in an amount from about 0.1% to about 3%, or from about 0.2% to about 2%, or from about 0.3% to about 1.5% by weight.

In one embodiment, the dispersant is an acylated amine. The acylated amine may be those described above as basic nitrogen compounds. In another embodiment, the acylated amine is prepared, as described above, by reacting one or more carboxylic acylating agent with one or more of the above amines, instead from 0.5 equivalents up to about 5, or from about 0.7 up to about 4, or from about 0.8 up to about 2 equivalents of amine per equivalent of carboxylic acylating agent. In one embodiment, from about 0.5 to about 1.5, or from about 0.6 to about 1.2, or from about 0.7 to about 1.1 or 1.0 equivalents of amine are reacted with each equivalent of acylating agent. When (A) is a basic nitrogen compound and an acylated amine, then (D) is different from (A).

In another embodiment, the dispersant may also be a carboxylic ester. The carboxylic ester is prepared by reacting at least one or more of the above carboxylic acylating agents, preferably a hydrocarbyl substituted carboxylic acylating agent, with at least one organic hydroxy compound and, optionally, an amine. In another embodiment, the carboxylic ester dispersant is prepared by reacting the acylating agent with at least one of the abovedescribed hydroxyamines.

The organic hydroxy compound includes compounds of the general formula $R''(OH)_m$ wherein R" is a monovalent or polyvalent organic group joined to the —OH groups through a carbon bond, and m is an integer from 1 to about 10. The hydroxy compounds may be aliphatic compounds, such as monohydric and polyhydric alcohols, or aromatic compounds, such as phenols and naphthols. The aromatic hydroxy compounds from which the esters may be derived are illustrated by the following specific examples: phenol, beta-naphthol, alpha-naphthol, cresol, resorcinol, catechol, pap'-dihydroxybiphenyl, 2-chlorophenol, 2,4-dibutylphenol, etc.

The alcohols from which the esters may be derived generally contain up to about 40 carbon atoms, or from 2 to about 30, or from 2 to about 10. The monohydric alcohols are described above. The hydroxy compounds may also be polyhydric alcohols, such as alkylene polyols. In one embodiment, the polyhydric alcohols contain from 2 to about 40 carbon atoms, from 2 to about 20; and from 2 to about 10 hydroxyl groups, or from 2 to about 6. Polyhydric alcohols include ethylene glycols, including di-, tri- and tetraethylene glycols; propylene glycols, including di-, tri- and tetrapropylene glycols; glycerol; butanediol; hexanediol; sorbitol; arabitol; mannitol; trimethylolpropane; sucrose; fructose; glucose; cyclohexanediol; erythritol; and pentaerythritols, including di- and tripentaerythritol.

The polyhydric alcohols may be esterified with monocarboxylic acids having from 2 to about 30 carbon atoms, or from about 8 to about 18, provided that at least one hydroxyl group remains unesterified. Examples of monocarboxylic acids include acetic, propionic, butyric and above described fatty acids. Specific examples of these esterified polyhydric alcohols include sorbitol oleate, including mono- and dioleate, sorbitol stearate, including mono- and distearate, glycerol oleate, including glycerol mono-, di- and trioleate and pentaerythritol octanoate.

The carboxylic ester dispersants may be prepared by any of several known methods. The method which is preferred because of convenience and the superior properties of the esters it produces, involves the reaction of the carboxylic acylating agents described above with one or more alcohol or phenol in ratios from about 0.5 equivalent to about 4 equivalents of hydroxy compound per equivalent of acylating agent. The esterification is usually carried out at temperatures above about 100° C., or between 150° C. and 300° C. The water formed as a by-product is removed by distillation as the esterification proceeds. The preparation of useful carboxylic ester dispersant is described in U.S. Pat. Nos. 3,522,179 and 4,234,435, and their disclosures are incorporated by reference.

The carboxylic ester dispersants may be further reacted with at least one of the above described amines and preferably at least one of the above described polyamines, such as a polyethylenepolyamine, condensed polyamine, or a heterocyclic amine, such as aminopropylmopholine. The amine is added in an amount sufficient to neutralize any nonesterified carboxyl groups. In one embodiment, the carboxylic ester dispersants are prepared by reacting from about 1 to about 2 equivalents, or from about 1.0 to 1.8 equivalents of hydroxy compounds, and up to about 0.3 equivalent, or from about 0.02 to about 0.25 equivalent of polyamine per equivalent of acylating agent. The carboxylic acid acylating agent may be reacted simultaneously with both the hydroxy compound and the amine. There is generally at least about 0.01 equivalent of the alcohol and at least 0.01 equivalent of the amine although the total amount of equivalents of the combination should be at least about 0.5 equivalent per equivalent of acylating agent. These carboxylic ester dispersant compositions are known in the art, and the preparation of a number of these derivatives is decribed in, for example, U.S. Pat. Nos. 3,957,854 and 4,234,435 which have been incorporated by reference previously.

In another embodiment, the dispernant may also be a hydrocarbyl-substituted amine. These hydrocarbyl-substituted amines are well known to those skilled in the art. These amines are disclosed in U.S. Pat. Nos. 3,275,554; 3,438,757; 3,454,555; 3,565,804; 3,755,433; and 3,822,289. These patents are hereby incorporated by reference for their disclosure of hydrocarbyl amines and methods of making the same. Typically, hydrocarbyl substituted amines are prepared by reacting olefins and olefin polymers, including the above polyalkenes and halogenated derivatives thereof, with amines (mono- or polyamines). The amines may be any of the amines described above, preferably an allylenepolyamine. Examples of hydrocarbyl substituted amines include poly(propylene)amine; N,N-dimethyl-N-poly (ethylene/propylene)amine, (50:50 mole ratio of monomers); polybutene amine; N,N-di(hydroxyethyl)-N-polybutene amine; N-(2-hydroxypropyl)-N-polybutene amine; N-polybutene-aniline; N-polybutene morpholine; N-poly(butene)ethylenediamine; N-poly(propylene) trimethylenediamine; N-poly(butene) diethylenetriamine; N',N'-poly(butene)tetraethylenepentamine;N,N-dimethyl-N'-poly(propylene)-1,3-propylenediamine, and the like.

In another embodiment, the dispersant may also be a Mannich dispersant. Mannich dispersants are generally formed by the reaction of (i) at least one aldehyde, typically those containing from one to about eight carbon atoms, such as formaldehyde or acetaldehyde, or at least one aldehyde precursor, such as paraformaldehyde or trioxane, (ii) at least one of the above described aminse and (iii) at least one alkyl substituted hydroxyaromatic compound. The reaction may occur from room temperature to about 225° C., or from about 50° to about 200° C., or from about 75° C. to about 150° C. The amounts of the reagents is such that the molar ratio of hydroxy-aromatic compound to formaldehyde to amine is in the range from about (1:1:1) to about (1:3:3).

The first reagent is an alkyl substituted hydroxyaromatic compound. This term includes the above described phenols. The hydroxyaromatic compounds are those substituted with at least one, and preferably not more than two, aliphatic or alicyclic groups having from about 6 up to about 400, or from about 30 up to about 300, or from about 50 up to about 200 carbon atoms. These groups may be derived from one or more of the above described olefins or polyalkenes. In one embodiment, the hydroxyaromatic compound is a phenol substituted with an aliphatic or alicyclic hydrocarbon-based group having an $\overline{M}n$ of about 420 to about 10,000.

The third reagent is any amine described above. Preferably the amine is one or more of the above described polyamines, such as the polyalkylenepolyamines or condensed polyamines. Mannich dispersants are described in the following patents: U.S. Pat. Nos. 3,980,569; 3,877,899; and 4,454,059 (herein incorporated by reference for their disclosure to Mannich dispersants).

In another embodiment, the dispersant is a borated dispersant. The borated dispersants are prepared by reacting one or more of the above disperants with one or more of the above described boron compound, such as boric acid. Typically, the borated dispersant contains from about 0.1% up to about 5%, or from about 0.5% up to about 4%, or from 0.7% up to about 3% by weight boron. In one embodiment, the borated dispersant is a borated acylated amine, such as a borated succinimide dispersant. Borated dispersants are described in U.S. Pat. Nos. 3,000,916; 3,087,936; 3,254,025; 3,282,955; 3,313,727; 3,491,025; 3,533,945; 3,666,662 and 4,925,983. These references are incorporated by reference for their disclosure of borated dispersants.

The following examples relate to dispersants useful in the present invention.

EXAMPLE D-1

A mixture is prepared by the addition of 8.16 parts (0.20 equivalent) of a commercial mixture of ethylene polyamines having from about 3 to about 10 nitrogen atoms per molecule to 113 parts of mineral oil and 161 parts (0.24 equivalent) of a polybutenyl ($\overline{M}n$=1845) substituted succinic acylating agent, having a saponification equivalent number of 87 as determined by ASTM procedure D-94, at 138° C. The reaction mixture is heated to 150° C. in 2 hours and stripped by blowing with nitrogen. The reaction mixture is filtered to yield the filtrate as an oil solution of the desired product.

EXAMPLE D-2

A mixture is prepared by the addition of 18.2 parts (0.433 equivalent) of a commercial mixture of ethylene polyamines having from about 3 to 10 nitrogen atoms per molecule to 392 parts of mineral oil and 348 parts (0.52 equivalent) of the polybutenyl ($\overline{M}n$=2020) substituted succinic acylating agent, having a saponification equivalent number of 87 as determined by ASTM procedure D-94, at 140° C. The reaction mixture is heated to 150° C. in 1.8 hours and stripped by blowing with nitrogen. The reaction mixture is filtered to yield the filtrate as an oil solution (55% oil) of the desired product.

Examples D-3 through D-8 are prepared by following the general procedure set forth in Example D-1.

| | Amine Reactant | Equivalent ratio of acylating agent to amine | Percent Diluent |
|---|---|---|---|
| D-3 | Pentaethylenehexamine[a] | 4:3 | 40% |
| D-4 | Tris(2-aminoethyl)amine | 5:4 | 50% |
| D-5 | Imino-bis-propylamine | 8:7 | 40% |
| D-6 | Hexamethylenediamine | 4:3 | 40% |
| D-7 | 1-(2-aminoethyl)-2-methyl-2-imidazoline | 5:4 | 40% |
| D-8 | N-aminopropylpyrrolidone | 8:7 | 40% |

[a]A commercial mixture of ethylene polyamines corresponding in empirical formula to pentaethylenehexamine.

EXAMPLE D-9

A mixture of 3660 parts (6 equivalents) of a substituted succinic acylating agent of Example D-1 in 4664 parts of diluent oil is prepared and heated at about 110° C. whereupon nitrogen is blown through the mixture. To this mixture there are then added 210 part (5.25 equivalents) of an allylenepolyamine mixture, comprising 80% of ethylene polyamine bottoms from Union Carbide and 20% of a commercial mixture of ethylenepolyamines corresponding in empirical formula to diethylnetriamine, over a period of one hour and the mixture is maintained at 110° C. for an additional 0.5 hour. The polyamine mixture is characterized as having an equivalent weight of about 43.3. After heating for 6 hours at 155° C., while removing water, a filtrate is added and the reaction mixture is filtered at about 150° C. The filtrate is the oil solution of the desired product.

EXAMPLE D-10

A substantially hydrocarbon-substituted succinic anhydride is prepared by chlorinating a polybutene having a number average molecular weight of 1000 to a chlorine content of 4.5% and then heating the chlorinated polybutene with 1.2 molar proportions of maleic anhydride at a temperature of 150–220° C. A mixture of 874 grams (1 mole) of the succinic anhydride and 104 grams (1 mole) of neopentyl glycol is maintained at 240–250° C./30 mm for 12 hours. The residue is a mixture of the esters resulting from the esterification of one and both hydroxy groups of the glycol.

EXAMPLE D-11

A mixture of 3225 parts (5.0 equivalents) of the polybutene-substituted succinic acylating agent of Example D-2, 289 parts (8.5 equivalents) of pentaerytritol and 5204 parts of mineral oil is heated at 224–235° C. for 5.5 hours. The reaction mixture is filtered at 130° C. to yield an oil solution of the desired product.

EXAMPLE D-12

A mixture of 1000 parts of polybutene having a number average molecular weight of about 1000 and 108 parts (1.1 moles) of maleic anhydride is heated to about 190° C. and 100 parts (1.43 moles) of chlorine are added beneath the surface over a period of about 4 hours while maintaining the temperature at about 185–190° C. The mixture then is blown with nitrogen at this temperature for several hours, and the residue is the desired polybutenyl-substituted succinic acylating agent.

A solution of 1000 parts of the above-prepared acylating agent in 857 parts of mineral oil is heated to about 150° C. with seg, and 109 parts (1.2 equivalents) of pentaerythritol are added with stirring. The mixture is blown with nitrogen and heated to about 200° C. over a period of about 14 hours to form an oil solution of the desired carboxylic ester intermediate. To the intermediate, there are added 19.25 parts (0.46 equivalent) of a commercial mixture of ethylene polyamines having an average of about 3 to about 10 nitrogen atoms per molecule. The reaction mixture is stripped by heating at 205° C. with nitrogen blowing for 3 hours and filtered. The filtrate is an oil solution (45% 100 neutral mineral oil) of the desired amine-modified carboxylic ester which contains 0.35% nitrogen.

EXAMPLE D-13

A mixture of 3225 parts (5.0 equivalents) of the polyisobutenyl (Mn=850) substituted succinic acylating agent, having a acid number of 113, 289 parts (8.5 equivalents) of pentaerythritol and 5204 parts of mineral oil is heated at 225°–235° C. for 5.5 hours. The reaction mixture is filtered at 130° C. to yield an oil solution of the desired product.

EXAMPLE D-14

A mixture of 322 parts (0.5 equivalent) of the polyisobutenyl-substituted succinic acylating agent of Example D-13, 68 parts (2.0 equivalents) of pentaerythritol and 508 parts of mineral oil is heated at 204°–227° C. for five hours. The reaction mixture is cooled to 162° C. and 5.3 parts (0.13 equivalent) of a commercial ethylene polyamine mixture having an average of about 3 to 10 nitrogen atoms per molecule is added. The reaction mixture is heated at 162°–163° C. for one hour, then cooled to 130° C. and filtered. The filtrate is an oil solution of the desired product.

EXAMPLE D-15

The procedure for Example D-14 is repeated except the 5.3 parts (0.13 equivalent) of ethylenepolyamine is replaced by 21 parts (0.175 equivalent) of trishydroxymethyl) aminomethane.

EXAMPLE D-16

A mixture of 1480 parts of the polyisobutenyl (Mn=1050) substituted succinic acylating agent, having an acid number of 105, 115 parts (0.53 equivalent) of a commercial mixture of $C_{12-18}$ straight-chain primary alcohols, 87 parts (0.594 equivalent) of a commercial mixture of $C_8$ straight-chain primary alcohols, 1098 parts of mineral oil and 400 parts of toluene is heated to 120° C. At 120° C., 1.5 parts of sulfuric acid is added and the reaction mixture is heated to 160° C. and held for three hours. To the reaction mixture is then added 158 parts (2.0 equivalents) of n-butanol and 1.5 parts of sulfuric acid. The reaction mixture is heated at 160° C. for 15 hours, then 12.6 parts (0.088 equivalent) of aminopropyl morpholine is added. The reaction mixture is held at 160° C. for an additional six hours, stripped at 150° C. under vacuum and filtered to yield an oil solution of the desired product.

EXAMPLE D-17

A mixture of 372 grams (6 equivalents of boron) of boric acid and 3111 grams (6 equivalents of nitrogen) of an acylated nitrogen composition, obtained by reacting 1 equivalent of a polybutenyl ($\overline{M}$n=850) succinic anhydride, having an acid number of 113 (corresponding to an equivalent weight of 500), with 2 equivalents of a commercial ethylene amine mixture having an average composition corresponding to that of tetraethylenepentamine, is heated at 150° C. for 3 hours and then filtered. The filtrate is found to have a boron content of 1.64% and a nitrogen content of 2.56%.

EXAMPLE D-18

Boric acid (124 grams, 2 equivalents of boron) is added to the acylated nitrogen composition (556 grams, 1 equivalent of nitrogen) of Example D-17. The resulting mixture is heated at 150° C. for 3.5 hours and filtered at that temperature. The filtrate is found to have a boron compound of 3.23% and a nitrogen content of 2.3%.

EXAMPLE D-19

(a) A reaction vessel is charged with 1000 parts of a polybutenyl ($\overline{M}n$=1000) substituted succinic anhydride, having a total acid number of 108, with a mixture of 275 grams of oil ad 139 part of a commercial mixture of polyamines corresponding to 85% E-100 amine bottoms and 15% diethylenetriamine. The reaction mixture is heated to 150 to 160° C. and the action temperature is maintained for four hours. The reaction is blown with nitrogen to remove water.

(b) A reaction vessel is charged with 1405 parts of the product of Example D-19a, 229 parts of boric acid, and 398 parts of diluent oil. The mixture is heated to 100 to 150° C. and the temperature maintained until water distillate ceases. The final product contains 2.3% nitrogen, 1.9% boron, 33% 100 neutral mineral oil and a total base number of 60.

Boron-Containing Antiwear/Extreme Pressure Agents (E)

The lubricants and/or functional fluids may additionally contain a boron antiwear or extreme pressure agent. Typically, the boron containing antiwear/extreme pressure agent is present in the lubricants and functional fluids at a level from about 0.01% up to about 10%, or from about 0.05% or up to about 4%, or from about 0.08% up to about 3%, or from 0.1% to about 2% by weight. Examples of boron containing antiwear/extreme pressure agents include a borated dispersant; an alkali metal or a mixed alkali metal, alkaline earth metal borate; a borated overbased metal salt; a borated epoxide; and a borate ester. The borated dispersant and borated overbased metal salt are described above. When (D) is a borated dispersant then (E) is different than (D). When (C) is a borated overbased salt, then (E) is different from (C).

In one embodiment, the boron antiwear or extreme pressure agent is an alkali or an alkali metal and alkaline earth metal borate. These metal borates are generally a hydrated particulate metal borate which are known in the art. Alkali metal borates include mixed alkali and alkaline metal borates. These metal borates are available commercially. Representative patents disclosing suitable alkali and alkali metal and alkaline earth metal borates and their methods of manufacture include U.S. Pat. Nos. 3,997,454; 3,819,521; 3,853,772; 3,907,601; 3,997,454; and 4,089,790. These patents are incorporated by reference for their disclosures of the metal borates and methods of their manufacture.

In another embodiment, the boron antiwear or extreme pressure agent is a borated fatty amine. The borated amines are prepared by reacting one or more of the above boron compounds with one or more of the above fatty amines, e.g., an amine having from about four up to about eighteen carbon atoms. The borated fatty amines are prepared by reacting the amine with the boron compound from about 50° C. to about 300° C.!, preferably from about 100° C. to about 250° C., and at a ratio from about 3:1 to about 1:3 equivalents of amine to equivalents of boron compound.

In another embodiment, the boron antiwear or extreme pressure agent is a borated epoxide. The borated fatty epoxides are generally the reaction product of one or more of the above boron compounds with at least one epoxide. The eporide is generally an aliphatic epoxide having from 8 up to about 30, preferably from about 10 up to about 24, more preferably from about 12 up to about 20 carbon atoms. Examples of useful aliphatic epoxides include heptyl epoxide, octyl epoxide, oleyl epoxide and the like. Mixtures of epoxides may also be used, for instance commercial mixtures of epoxides having from about 14 to about 16 carbon atoms and from about 14 to about 18 carbon atoms. The borated fatty epoxides are generally known and are disclosed in U.S. Pat. No. 4,584,115. This patent is incorporated by reference for its disclosure of borated fatty epoxides and methods for preparing the same.

In one embodiment, the boron antiwear or extreme pressure agent is a borate ester. The borate esters may be prepared by reacting of one or more of the above boron compounds with one or more of the above alcohols. Typically, the alcohols contain from about 6 up to about 30, or from about 8 to about 24 carbon atoms. The methods of making such borate esters are known to those in the art.

In another embodiment, borate ester is a borated phospholipid. The borated phospholipids are prepared by reacting a combination of a phospholipid and a boron compound, Optionally, the combination may include an amine, an acylated nitrogen compound, a carboxylic ester, a Mannich reaction product, or a neutral or basic metal salt of an organic acid compound. These additional components are described above. Phospholipids, sometimes referred to as phosphatides and phospholipins, may be natural or synthetic. Naturally derived phospholipids include those derived from fish, fish oil, shellfish, bovine brain, chicken egg, sunflowers, soybean, corn, and cottonseeds. Phospholipids may be derived from microorganisms, including blue-green algae, green algae, and bacteria.

The reaction of the phospholipid and the boron compound usually occurs at a temperature from about 60° C. up to about 200° C., or from about 90° C., or up to about 150° C. The reaction is typically accomplished in about 0.5 up to about 10 hours. The boron compound and phospholipid are reacted at an equivalent ratio of boron to phosphorus of 1–6:1 or 2–4:1, or 3:1. When the combination includes additional components (e.g. amines, acylated amines, neutral or basic meal salts, etc.), the boron compound is reacted with the mixture of the phospholipid and one or more optional ingredients in an amount of one equivalent of boron to an equivalent of the mixture of a phospholipid and an optional ingredient in a ratio from about one, or about two up to about six, to about four to one. The equivalents of the mixture are based on the combined equivalents of phospholipid based on phosphorus and equivalents of the optional ingredients.

Lubricants

The lubricating compositions and methods of this invention employ an oil of lubricating viscosity. The oil of lubricating viscosity is generally present in a major amount (i.e. an amount greater than about 50% by weight). In one embodiment, the oil of lubricating viscosity is present in an amount greater than about 60%, or greater than about 70%, or greater than about 80% by weight of the composition. The oils of lubricating viscosity include natural or synthetic lubricating oils and mixtures thereof. Natural oils include animal oils, vegetable oils, mineral lubricating oils, and solvent or acid treated mineral oils. Synthetic lubricating oils include hydrocarbon oils (polyalpha-olefins), halo-substituted hydrocarbon oils, alkylene oxide polymers, esters of dicarboxylic acids and polyols, esters of phosphorus-containing acids, polymeric tetrahydrofurans and silicon-based oils. Unrefined, refined, and rerefined oils, either natural or synthetic, may be used in the compositions of the present invention. A description of oils of lubricating viscosity occurs in U.S. Pat. No. 4,582,618 (column 2, line 37 through column 3, line 63, inclusive), herein incorporated by reference for its disclosure to oils of lubricating viscosity.

In one embodiment, the oil of lubricating viscosity is a Group II base oil, as referred to in the API base oil interchangeability guidelines. These oils have leSS than or equal to 0.03% sulfur, greater than or equal to 90% saturates, and greater than or equal to 80 viscosity index. The inventors have discovered that the lubricants and/or functional fluids prepared with these oils may have seal life problems without the use of the additives of the present invention.

In one embodiment, the oil of lubricating viscosity or a mixture of oils of lubricating viscosity are selected to provide lubricating compositions with a kinematic viscosity of at least about 3.5 cSt, or at least about 4.0 cSt at 100° C. In one embodiment, the lubricating compositions have an SAE gear viscosity number of at least about SAE 65, more preferably at least about SAE 75. The lubricating composition may also have a so-called multigrade rating such as SAE 75W-80, 75W-90, 75W-90, 75W-140, or 80W-90.

Multigrade lubricants may include a viscosity improver which is formulated with the oil of lubricating viscosity to provide the above lubricant grades. Useful viscosity improvers include but are not limited to polyolefins, such as ethylene-propylene copolymers, or polybutylene rubbers, including hydrogenated rubbers, such as styrene-butadiene or styrene-isoprene rubbers; or polyacrylates, including polymethacrylates. Preferably the viscosity improver is a polyolefin or polymethacrylate, more preferably polymethacrylate. Viscosity improvers available commercially include Acryloid™ viscosity improvers available from Rohm & Haas; Shellvis™ rubbers available from Shell Chemical; Exxon OCP polymer, available from Exxon Chemical Co.; Hitec polymers available from Ethyl Corporation; Trilene™ polymers, such as Trilene™ CP40, available commercially from Uniroyal Chemical Co., and Lubrizol® 3100 series and 8400 series polymers, such as Lubrizol® 3174 available from The Lubrizol Corporation.

In another embodiment, the oil of lubricating viscosity is selected to provide lubricating compositions for crankcase applications, such as for gasoline and diesel engines. Typically, the lubricating compositions are selected to provide an SAE crankcase viscosity number of 10W, 20W, or 30W lubricants. The lubricating composition may also have a so called multi-grade rating such as SAE 5W-30, 10W-30, 10W-40, 20W-50, etc. As described above, multi-grade lubricants include a viscosity improver which is formulated with the oil of lubricating viscosity to provide the above lubricant grades.

Additional Additives

In one embodiment, the lubricating compositions and functional fluids contain one or more auxiliary extreme pressure and/or antiwear agents, corrosion inhibitors and/or oxidation inhibitors. Auxiliary extreme pressure agents and corrosion and oxidation inhibiting agents which may be included in the lubricants and functional fluids of the invention are exemplified by chlorinated aliphatic hydrocarbons such as chlorinated wax; metal thiocarbamates, such as zinc dioctyldithiocarbamate, and barium heptylphenyl dithiocarbamate; dithiocarbamate esters from the reaction product of dithiocarbamic acid and acrylic, methacrylic, maleic, fumaric or itaconic esters (e.g. the reaction product of dibutylamine, carbon disulfide, and methyl acrylate); dithiocarbamate containing amides, prepared from dithiocarbamic acid and an acrylamide (e.g. the reaction product of dibutylamine, carbon disulfide, and acrylamide); alkylene-coupled dithiocarbamates (e.g. methylene or phenylene bis (dibutyldithiocarbamate); sulfur-coupleddithiocarbamates (e.g.bis(S-alkyldithiocarbamoyl) disulfides). Many of the above-mentioned auxiliary extreme pressure agents and corrosion-oxidation inhibitors also serve as antiwear agents.

The lubricating compositions and functional fluids may contain one or more pour point depressants, color stabilizers, metal deactivators and/or anti-foam agents. Pour point depressants are a particularly useful type of additive often included in the lubricating oils describe herein. The use of such pour point depressants in oil-based compositions to improve low temperature properties of oil-based compositions is well known in the art. See, for example, page 8 of "Lubricant Additives" by C. V. Smalheer and R. Kennedy Smith Lezius-Hiles Co. publishers, Cleveland, Ohio, 1967). Examples of useful pour point depressants are polymethacrylates; polyacrylates; polyacrylamides; condensation products of haloparaffin waxes and aromatic compounds; vinyl carboxylate polymers; and terpolymers of diallylfumarates, vinyl esters of fatty acids and alkyl vinyl ethers. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715 which are herein incorporated by reference for their relevant disclosures.

Anti-foam agents are used to reduce or prevent the formation of stable foam. Typical anti-foam agents include silicones or organic polymers. Additional anti-foam compositions are described in "Foam Control Agents", by Henry T. Kemer (Noyes Data Corporation, 1976), pages 125–162.

These additional additives, when used, are present in the inventive lubricating and functional fluid compositions at sufficient concentrations to provide the compositions with enhanced properties depending upon their intended use. For example, the detergents are added at sufficient concentrations to provide the inventive compositions with enhanced detergency characteristics, while the antifoam agents are added at sufficient concentrations to provide the inventive compositions with enhanced antifoaming characteristics. Generally, each of these additional additives are present in the lubricants and functional fluids at concentrations from about 0.01%, or from about 0.05%, or from about 0.5%. These additional additives are generally present in an amount up to about 20% by weight, or up to about 10% by weight, and or up to about 3% by weight.

The following examples illustrate the lubricants of the present invention. Unless otherwise indicated, in the examples as well as throughout the specification and the appended claims, all parts and percentages are by weight, all temperatures are in degrees centigrade, and all pressures are atmospheric.

EXAMPLE I

A gear lubricant is prepared by incorporating 3.5% of the product of Example S-1, 1.5% of the product of example P-3, and 2.5% dodecanethiol into a SAE 75W-90 lubricating oil mixture.

EXAMPLE II

A lubricant is prepared as described in Example I, except the lubricant includes 0.9% of the product of Example B4.

EXAMPLE III

A gear lubricant is prepared by incorporating 3.1% of the product of Example S-4 and 2.0% nonanethiol into an SAE 75W-140 lubricating oil mixture.

EXAMPLE IV

A gear lubricant is prepared by incorporating 3.3% of the product of Example S-1, 0.9% of the product of Example O-2b and 3.5% of dodecanethiol into an SAE 80W-90 lubricating oil mixture.

EXAMPLE V

A gear lubricant is prepared by incorporating 0.5% of oleylamine, 3.5% of the product of Example S-1, 0.9% of the product of Example O-1a, and 2.5% of dodecanethiol into an SAE 75W-90 lubricating oil mixture.

EXAMPLE VI

A gear lubricant is prepared by incorporating 3.5% of the product of Example S-1, 1.2% of the product of Example O-5, and 2.9% of octadecanethiol into an SAE 75W-140 lubricating oil mixture.

EXAMPLE VII

A lubricant is prepared by incorporating 4.5% of the product of Example N-3 and 0.5% dodecanethiol into a SAE 10W-40 lubricating oil mixture.

EXAMPLE VIII

A lubricant is prepared by incorporating 1.2% of zinc isopropyl, isooctyl dithiophosphate, and 1% dodecanethiol into a SAE 10W-40 lubricating oil mixture.

EXAMPLE IX

A lubricant is prepared as described in Example VIII, except the lubricant includes 0.9% of the product of Example B-4.

The lubricant formulations identified in Table I are SAE 30 diesel engine oils within the scope of the invention. Each of these engine oils pass the Allison C-4 Seal Test sequence. In Table I all numerical values are in percent by weight except for the silicone antifoam agent which is in parts per million (ppm). In lubricant A, 26.9% of a 150 neutral mineral oil is mixed with 54.7% of 600 neutral mineral oil are mixed with the additives listed below. In lubricant B, 49.0% of 240 neutral mineral oil and 32.6% of 500 neutral mineral oil are mixed with the additives listed below.

TABLE I

| | A | B |
|---|---|---|
| Sulfurized Diels Alder adduct[a] | 0.60 | 0.60 |
| Zinc isopropyl isooctyl dithiophosphate | 0.65 | 0.65 |
| Zinc isopropyl 4-methyl pentyl dithiophosphate | 0.60 | 0.60 |
| Dodecyl mercaptan | 0.5 | 0.5 |
| Product of Example N-3 | 4.5 | 4.5 |
| Dispersant[b] | 3.0 | 3.0 |
| Product of Example D-12 | 1.5 | 1.5 |
| Product of Example B-4 | 0.9 | 0.9 |
| Heptylphenyl-(oxyethylene)$_4$-OH | 0.10 | 0.10 |
| $C_9$ mono- and di-para-alkylated diphenylamine | 0.60 | 0.60 |
| Propylenetetramer phenol | 0.5 | 0.5 |
| Neutral calcium sulfonate[c] | 1.5 | 1.5 |
| Magnesium salicylate[d] | 2.9 | 2.9 |
| Silicone antifoam agent | 100 ppm | 100 ppm |
| Diluent oil | 0.55 | 0.55 |

[a]A sulfurized Diels-Alder product of butadiene and butyl acrylate.
[b]the reaction product of 1 equivalent of polybutenyl (Mn = 850) succinic anhydride and 1.1 equivalents of the polyamine mixture of Example B-4.

TABLE I-continued

| | A | B |
|---|---|---|

[c]a 50% oil mixture of a synthetic alkylbenzene calcium sulfonate having a metal ratio of 1.2.
[d]a 50% oil mixture of a $C_{13-18}$ alkylphenol calcium salicylate having a metal ratio of 2.9.

The following table relates to gear oils which help to extend the life of seals. The gear oils have a SAE 80W-90 base fluid comprised of 35.5% by weight Citgo 200 neutral mineral oil and 64.5% by weight Citgo 150 Bright Stock. Each of the oils contains 0.75% by weight a polymethacrylate pour point depressant having a Mn=31000 and Mw=55000.

| | C | D | E | F | G |
|---|---|---|---|---|---|
| 1-dodecanethiol | 2.9 | 2.9 | 2.9 | 2.9 | 3.0 |
| Product of Ex. S-1 | 3.1 | 1.7 | 3.2 | 3.5 | 3.8 |
| Product of Ex. S-2 | — | 1.7 | — | — | — |
| Product of Ex. P-3 | 1.2 | 1.2 | 1.2 | 1.4 | 1.3 |
| Product of Ex. B-4 | 0.9 | 1.3 | 1.3 | 1.3 | — |
| Product of Ex. O-6(b) | — | — | — | 1.2 | — |
| triphenylphosphite | — | — | — | 0.3 | — |
| monoisopropanolamine | 0.03 | 0.03 | — | — | — |
| oleylamine | — | — | — | — | 0.3 |
| oleylamide | 0.1 | 0.1 | 0.1 | — | — |
| DMTD derivative | 0.1[a] | 0.1[a] | 0.1[a] | 0.9[b] | 0.1[a] |
| DMTD derivative[c] | 0.02 | 0.01 | 0.02 | — | 0.02 |
| Imidazoline derivative[d] | — | — | 0.05 | — | — |
| Dispersant[e] | — | — | — | 0.6 | — |
| Glycerol monooleate | — | — | — | 0.2 | — |
| Acrylate copolymer[f] | 0.07 | 0.05 | 0.07 | — | 0.06 |
| TOLAD 370 | — | — | 0.02 | — | — |
| Polydimethyl siloxane | — | — | — | 0.02 | — |
| decylsulfolane | 0.15 | — | — | — | — |

[a]a reaction product of heptylphenol, formaldehyde and dimercaptothiadiazole.
[b]a reaction product of dimercaptothiadiazole and a carboxylic ester dispersant prepared by reacting a polybutenyl (Mn = 950) substituted succinic anhydride with penteaerythritol and polyethylene polyamines.
[c]a reaction product of octyl mercaptan and dimercaptothiadiazole
[d]a substituted imidazoline from oleylamine
[e]reaction product of polybutenyl (Mn = 850) succinic anhydride and tetraethylenepentaamine.
[f]a copolymer of methylacrylate and 2-ethylhexylacrylate.

An advantage of the present invention is that lubricating and functional fluid compositions are provided that employ sulfur-containing antiwear/extreme pressure agents and/or basic nitrogen compounds and yet are useful in engines, drive train components and other applications wherein elastomeric seals (e.g., nitrile, polyacrylate, silicone, ethylene acrylic and fluoroelastomers) come into contact with the lubricants and functional fluids. By combining the hydrocarbyl mercaptans (B) with the sulfur-containing antiwear/extreme pressure agents and/or basic nitrogen compounds (A) in the inventive lubricants and functional fluids, the life of these seals is extended. Thus, in one embodiment the invention contemplates a method, for extending the life of an elastomeric seal, comprising combining a hydrocarbyl mercaptan with the lubricating or functional fluid composition and contacting the seal with the lubricating or functional fluid composition.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A composition comprising (A) at least one antiwear or extreme pressure agent containing sulfur, at least one basic nitrogen compound, or a mixture thereof; and (B) at least one hydrocarbyl mercaptan; with the proviso that when (A) is an organic polysulfide, then the composition further comprises (C) at least one phosphorus containing antiwear or extreme pressure agent, at least one overbased composition, or mixtures thereof, wherein (C) is different from (A), further comprising at least one sulfolene seal swell agent.

2. The composition of claim 1 wherein (A) is a sulfur compound, a metal thiophosphate, or mixtures thereof.

3. The composition of claim 1 wherein (A) is a sulfurized oil, unsaturated fatty acid, unsaturated fatty ester, olefin, terpene, or Diels-Alder adduct.

4. The composition of claim 1 wherein (A) is at least one dialkyl polysulfide.

5. The composition of claim 1 wherein (A) is a fatty amine or an acylated amine.

6. The composition of claim 5 wherein the fatty amine is selected from the group consisting of n-octylamine, n-decylamine, n-dodecylamine, n-tetradecylamine, n-hexadecylamine, n-octadecylamine, oleyamine, cocoaamine, tallowamine, and soyaamine.

7. The composition of claim 1 wherein (A) is a reaction product of a hydrocarbyl substituted carboxylic acylating agent and at least one amine characterized by the presence within its structure of at least one H—N< group.

8. The composition of claim 7 wherein the amine is a polyalkylenepolyamine.

9. The composition of claim 1 wherein (A) has a total base number of at least about 30.

10. The composition of claim 1 wherein the hydrocarbyl group of (B) is free of ether linkages.

11. The composition of claim 1 wherein (B) contains from about 8 to about 30 carbon atoms.

12. The composition of claim 1 wherein (B) is selected from the group consisting of octyl, nonyl, decyl, dodecyl, tetradecyl, hexadecyl, and octadecyl mercaptan.

13. The composition of claim 1 wherein (C) is selected from the group consisting of a phosphoric acid ester or salt thereof; a phosphite; and a phosphorus-containing carboxylic acid, ester, ether, or amide.

14. The composition of claim 1 wherein (C) is an alkali or alkaline earth metal salt of an acidic organic compound.

15. The composition of claim 1 wherein (C) is a sodium, calcium, or magnesium sulfonate, carboxylate, or phenate.

16. The composition of claim 1 wherein (C) is a borated overbased metal composition.

17. The composition of claim 1 wherein (C) is a sulfurized overbased composition.

18. The composition of claim 1 wherein (A) is other than organic polysulfide and the composition further comprises (C) a phosphorous containing antiwear or extreme pressure agent, at least one overbased composition, or a mixture, thereof.

19. The composition of claim 1 further comprising (D) at least one dispersant, wherein (D) is different from (A).

20. The composition of claim 19 wherein the dispersant (D) is selected from the group consisting of an acylated amine, a hydrocarbyl amine, a carboxylic ester, a polymeric, a post treated product thereof, and a mixture of two or more thereof.

21. The composition of claim 19 wherein the dispersant (D) is the reaction product of a hydrocarbyl substituted carboxylic acylating agent and at one amine characterized by the presence within its structure of at least one H—N< group.

22. The composition of claim 1 further comprising (E) at least one boron containing antiwear or extreme pressureagent.

23. A composition comprising (A) at least one antiwear or extreme pressure agent containing sulfur, at least one basic nitrogen compound, or a mixture thereof; (B) at least one hydrocarbyl mercaptan containing from about 8 to about 30 carbon atoms; and (D) at least one dispersant, wherein (D) is different from (A), further comprising at least one sulfolene seal swell agent.

24. The composition of claim 23 wherein (A) is a sulfur compound, a metal thiophosphate, or mixtures thereof.

25. The composition of claim 23 wherein (A) is a dialkyl polysulfide or a zinc dithiophosphate.

26. The composition of claim 23 wherein the mercaptan (B) is selected from the group consisting of octyl, nonyl, decyl, dodecyl, tetradecyl, hexadecyl, and octadecyl mercaptan.

27. The composition of claim 23 wherein the dispersant (D) is selected from the group consisting of an acylated amine, a hydrocarbyl amine, a carboxylic ester, a polymeric, a post treated product thereof, and a mixture of two or more thereof.

28. The composition of claim 23 wherein the dispersant (D) is a reaction product of a hydrocarbyl substituted carboxylic acylating agent and at least one amine characterized by the presence within its structure of at least one H—N< group.

29. The composition of claim 23 wherein (D) is a borated reaction product of a hydrocarbyl substituted carboxylic acylating agent and at least one polyamine.

30. A composition comprising (A) at least one antiwear or extreme pressure agent containing sulfur, at least one basic nitrogen compound, or mixture thereof, (B) at least one hydrocarbyl mercaptan containing from about 8 to about 30 carbon atoms, and (C) at least one phosphorus containing antiwear or extreme pressure agent, at least one overbased composition, or mixtures thereof, wherein (C) is different from (A), further comprising at least one sulfolene seal swell agent.

31. The composition of claim 30 wherein (A) is a sulfur compound, a metal thiophosphate, or mixtures thereof.

32. The composition of claim 30 wherein (A) is a sulfurized Diels-Alder adduct, a sulfurized olefin, or a zinc dithiophosphate.

33. The composition of claim 30 wherein (B) is selected from the group consisting of decyl, dodecyl, tetradecyl and hexadecyl mercaptan.

34. The composition of claim 30 wherein (C) is selected from the group consisting of a phosphoric acid ester or salt thereof; a phosphite; and a phosphorus-containing carboxylic acid, ester, ether, or amide.

35. The composition of claim 30 wherein (C) is a borated overbased compound or a sulfurized overbased composition.

36. The composition of claim 30 further comprising (E) at least one boron antiwear or extreme pressure agent.

37. A lubricating composition or functional fluid comprising an oil of lubricating viscosity and the composition of claim 1.

38. A lubricating composition or functional fluid comprising an oil of lubricating viscosity and the composition of claim 2.

39. A lubricating composition or functional fluid comprising an oil of lubricating viscosity and the composition of claim 3.

40. The composition of claim 36 wherein the lubricating composition contains at least about 0.07% by weight nitrogen.

41. The composition of claim 37 wherein the lubricating composition is a gear oil.

42. A concentrate comprising from about 10% to about 99% by weight of a substantially inert organic diluent and the composition of claim 1.

43. A concentrate comprising from about 10% to about 99% by weight of a substantially inert organic diluent and the composition of claim 23.

44. A concentrate comprising from about 10% to about 99% by weight of a substantially inert organic diluent and the composition of claim 30.

* * * * *